US011476041B2

(12) United States Patent
Suzuki et al.

(10) Patent No.: US 11,476,041 B2
(45) Date of Patent: Oct. 18, 2022

(54) COIL COMPONENT AND MANUFACTURING METHOD THEREFOR

(71) Applicant: TDK Corporation, Tokyo (JP)

(72) Inventors: Masanori Suzuki, Tokyo (JP); Manabu Yamatani, Tokyo (JP); Takuya Takeuchi, Tokyo (JP); Ikuya Kokubo, Tokyo (JP); Tomonaga Nishikawa, Tokyo (JP); Naoaki Fujii, Tokyo (JP); Nobuya Takahashi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 792 days.

(21) Appl. No.: 16/265,522

(22) Filed: Feb. 1, 2019

(65) Prior Publication Data

US 2019/0244750 A1 Aug. 8, 2019

(30) Foreign Application Priority Data

Feb. 6, 2018 (JP) ..... JP2018-019299

(51) Int. Cl.

| | |
|---|---|
| ***H01F 27/28*** | (2006.01) |
| ***H01F 27/32*** | (2006.01) |
| ***H01F 41/04*** | (2006.01) |
| ***H01F 41/12*** | (2006.01) |
| ***H01F 27/24*** | (2006.01) |

(52) U.S. Cl.

CPC ..... *H01F 27/327* (2013.01); *H01F 27/24* (2013.01); *H01F 27/2804* (2013.01); *H01F 41/041* (2013.01); *H01F 41/127* (2013.01); *H01F 2027/2809* (2013.01)

(58) Field of Classification Search

USPC ..... 336/200, 232, 192, 83

See application file for complete search history.

(56) References Cited

U.S. PATENT DOCUMENTS

| | | | | |
|---|---|---|---|---|
| 2013/0169401 | A1 | 7/2013 | Lee et al. | |
| 2013/0222101 | A1* | 8/2013 | Ito | H01F 3/08 336/83 |
| 2014/0184374 | A1* | 7/2014 | Park | H01F 27/255 336/83 |
| 2017/0169930 | A1* | 6/2017 | Kudo | H01F 17/0013 |
| 2018/0122556 | A1* | 5/2018 | Kim | H01F 41/041 |
| 2019/0088414 | A1* | 3/2019 | Oota | H05K 3/12 |
| 2019/0189340 | A1* | 6/2019 | Kim | H01F 27/323 |
| 2019/0362886 | A1* | 11/2019 | Bong | H01F 17/0013 |

FOREIGN PATENT DOCUMENTS

JP 2013140939 A 7/2013

* cited by examiner

*Primary Examiner* — Shawki S Ismail
*Assistant Examiner* — Kazi S Hossain
(74) *Attorney, Agent, or Firm* — Young Law Firm, P.C.

(57) ABSTRACT

A coil component is provided with a coil part in which a plurality of conductor layers and a plurality of interlayer insulating layers are alternately laminated; and a sealing resin layer that covers the coil part. The conductor layers each include a spiral pattern. The interlayer insulating layers each cover an upper surface and a side surface of the spiral pattern. The recessed part is formed in the side wall surface of the interlayer insulating layer. A part of the sealing resin layer is embedded in the recessed part.

18 Claims, 18 Drawing Sheets

COIL COMPONENT AND MANUFACTURING METHOD THEREFOR

BACKGROUND OF THE INVENTION

Field of the Invention

The present invention relates to a coil component and a manufacturing method therefor and, more particularly, to a coil component having a sealing resin layer for embedding therein a coil pattern formed by electrolytic plating and a manufacturing method therefor.

Description of Related Art

As a coil component having a sealing resin layer for embedding therein a coil pattern, Japanese Patent Application Laid-Open No. 2013-140939 discloses a coil component having a structure in which a coil part having a planar spiral conductor is formed on a magnetic substrate through an insulating resin layer, and the opening and the upper surface of the coil part is covered with a magnetic resin layer.

However, in conventional coil components, the magnetic resin layer and the insulating resin layer wrapping the surface of the coil part differ in thermal expansion coefficient, so that when a reliability test or the like is performed, peeling may occur at the boundary between the magnetic resin layer and the insulating resin layer.

SUMMARY

The object of the present invention is to provide a coil component capable of preventing the occurrence of peeling between the coil part and a sealing resin layer, such as the magnetic resin layer, around the coil part and a manufacturing method therefor.

To solve the above problem, a coil component according to the present invention has a coil part in which a plurality of conductor layers and a plurality of interlayer insulating layers are alternately laminated and a sealing resin layer that covers the coil part. The conductor layers each include a spiral pattern. The interlayer insulating layers each cover an upper surface and a side surface of the spiral pattern. A recessed part is formed in the side wall surface of the interlayer insulating layer. A part of the sealing resin layer is embedded in the recessed part.

According to the present invention, a part of the sealing resin layer can be made to bite in the side wall surfaces of the respective interlayer insulating layers of the coil part. Thus, even when the thermal expansion coefficient differs between the sealing resin layer and the interlayer insulating layers, adhesion between the sealing resin layer and the coil part can be improved by anchor effect, whereby quality degradation in a reliability test or the like is prevented to make it possible to improve reliability and durability of the coil component.

In the present invention, it is preferable that the sealing resin layer is a magnetic resin layer containing metal magnetic particles and resin binder and that the resin binder is embedded in the recessed part while preventing the metal magnetic particles from being embedded in the recessed part. Since only the resin binder is embedded in the recessed part, it is possible to improve coil characteristics while securing insulating performance of the coil part.

In the present invention, it is preferable that at least one of the plurality of conductor layers further includes at least one auxiliary pattern connected to the innermost turn or outermost turn of the spiral pattern, that the interlayer insulating layer covers the upper and side surfaces of the spiral pattern and also covers the upper surface of the auxiliary pattern, and that the recessed part is formed at a position from which the side surface of the auxiliary pattern is exposed. With the above configuration, when the spiral pattern is formed by electrolytic plating, plating current can be supplied from the auxiliary pattern to the spiral pattern, or plating current can be supplied from the spiral pattern to another conductor pattern through the auxiliary pattern, whereby a spiral pattern having a uniform thickness over the entire length thereof can be formed. Further, a process of removing a part of the auxiliary pattern is used to form the recessed part in the side wall surface of the interlayer insulating layer.

In the present invention, the auxiliary pattern preferably includes an inner auxiliary pattern connected to the innermost turn of the spiral pattern. When an inner dummy pattern provided in the inner diameter area of the spiral pattern is subjected to electrolytic plating together with the spiral pattern, plating current can be supplied from the spiral pattern to the inner dummy pattern through the inner auxiliary pattern, whereby a spiral pattern having a uniform thickness over the entire length thereof can be formed.

In the present invention, the auxiliary pattern preferably further includes an outer auxiliary pattern connected to the outermost turn of the spiral pattern. Even when a terminal pattern is not formed at the outer peripheral end of the spiral pattern, plating current can be supplied from the outer auxiliary pattern to the outermost turn of the spiral pattern, whereby a spiral pattern having a uniform thickness over the entire length thereof can be formed.

In the present invention, it is preferable that the coil part has three or more conductor layers and that both the inner auxiliary pattern and the outer auxiliary pattern are provided in an intermediate conductor layer between the lowermost and uppermost layers. A terminal pattern is generally formed at the outer peripheral end of the spiral pattern included in each of the uppermost and lowermost conductor layers, so that power can be easily supplied to the outermost turn; however, such a terminal pattern is not formed in the spiral pattern included in the intermediate conductor layer, making it difficult to supply power to the spiral pattern. Further, when the inner auxiliary pattern is not provided at the innermost turn of the spiral pattern in a case where the inner dummy pattern provided in the inner diameter area of the spiral pattern is subjected to electrolytic plating together with the spiral pattern, it is difficult to supply power to the inner dummy pattern. However, when both the inner auxiliary pattern and the outer auxiliary pattern are provided for the spiral pattern included in the intermediate conductor layer, power can easily be supplied to the inner dummy pattern and the spiral pattern.

It is preferable that the lowermost and uppermost conductor layers of the plurality of conductor layers have the inner auxiliary pattern and do not have the outer auxiliary pattern. As described above, a terminal pattern is formed at the outer peripheral end of the spiral pattern included in each of the uppermost and lowermost conductor layers, so that power supply to the spiral pattern can be achieved using the terminal pattern, and power supply to the inner dummy pattern provided in the inner diameter area of the spiral pattern can be achieved using the inner auxiliary pattern.

In the present invention, it is preferable that the coil part is formed by alternately laminating first to fourth conductor layers and first to fourth interlayer insulting layers, that the first and fourth conductor layers each include the spiral pattern and the inner auxiliary pattern, and that the second and third conductor layers each include the spiral pattern, the inner auxiliary pattern and the outer auxiliary pattern. When both the inner auxiliary pattern and the outer auxiliary pattern are provided for the spiral pattern included in each of the second and third conductor layers as the intermediate layers, power can easily be supplied to the spiral pattern and inner dummy pattern.

In the present invention, the auxiliary pattern preferably has a bend. With this configuration, it is possible to increase the distance from the leading end of the auxiliary pattern to the spiral pattern, thereby making it possible to prevent even a part of the spiral pattern from being over-etched when the auxiliary pattern is etched to form the recessed part.

In the present invention, it is preferable that the plurality of conductor layers each have a seed layer and a plating layer formed on the seed layer by electrolytic plating, that each spiral pattern is constituted by the seed layer and the plating layer, and that the auxiliary pattern is constituted by the seed layer. As described above, the auxiliary pattern can be formed by using the seed layer used for forming the spiral pattern by electrolytic plating and, further, the recessed part can be formed in the side wall surface of the interlayer insulating layer by using the thus formed auxiliary pattern.

In the present invention, it is preferable that the height of the recessed part is 1 μm to 10 μm and that the depth thereof is 3 μm to 25 μm. This can improve adhesion between the coil part and the sealing resin layer.

A manufacturing method for a coil component according to the present invention includes the steps of: forming a coil part by alternately repeating a formation of a conductor layer including a spiral pattern and a formation of an interlayer insulating layer that covers the upper and side surfaces of the spiral pattern; and forming a first sealing resin layer that covers the coil part. The step of forming the coil part includes a step of forming a recessed part in a side wall surface of the interlayer insulating layer. The step of forming the first sealing resin layer includes a step of embedding a part of the first sealing resin layer in the recessed part.

According to the present invention, a part of the first sealing resin layer can be made to bite in the side wall surface of the interlayer insulating layer of the coil part. Thus, even when the thermal expansion coefficient differs between the first sealing resin layer and the interlayer insulating layer, adhesion between the first sealing resin layer and the coil part can be improved by anchor effect, whereby quality degradation in a reliability test or the like is prevented to make it possible to improve reliability and durability of the coil component.

In the present invention, the step of forming the conductor layer preferably includes the steps of forming a seed layer including the spiral pattern and at least one auxiliary pattern connected to the innermost turn or outermost turn of the spiral pattern; forming a resist pattern selectively covering the seed layer; applying electrolytic plating to the seed layer; and selectively removing an unnecessary part of the conductor pattern by etching while leaving the spiral pattern. The step of removing an unnecessary conductor pattern preferably includes a step of removing at least a part of the auxiliary pattern covered with the resist pattern and a step of forming the recessed part. With this configuration, it is possible to form the recessed part only by removing an unnecessary conductor pattern without conducting a special process for forming the recessed part.

In the present invention, it is preferable that the seed layer further includes an inner dummy pattern formed in the inner diameter area of the spiral pattern and an outer dummy pattern formed in the outer peripheral area of the spiral pattern, that the auxiliary pattern includes an inner auxiliary pattern that short-cuts the inner dummy pattern and the innermost turn of the spiral pattern, that the step of applying electrolytic plating to the seed layer supplies power to the spiral pattern through the inner dummy pattern and inner auxiliary pattern, and that the step of removing an unnecessary part of the conductor pattern removes the inner dummy pattern and outer dummy pattern together with at least a part of the inner auxiliary pattern. With this configuration, during the electrolytic plating, plating current can easily be supplied to the inner dummy pattern by using the inner auxiliary pattern. Further, the recessed part can be formed in the side wall surface of the interlayer insulating layer simultaneously with the removal of the inner and outer dummy patterns.

In the present invention, it is preferable that the auxiliary pattern further includes an outer auxiliary pattern that short-cuts the outer dummy pattern and the outermost turn of the spiral pattern, that the step of applying electrolytic plating to the seed layer supplies power to the spiral pattern through the outer dummy pattern and outer auxiliary pattern, and that the step of removing an unnecessary part of the conductor pattern removes the inner dummy pattern and outer dummy pattern together with at least a part of the inner auxiliary pattern and at least a part of the outer auxiliary pattern. With this configuration, during the electrolytic plating, plating current can easily be supplied to the spiral pattern by using the outer auxiliary pattern. Further, the recessed part can be formed in the side wall surface of the interlayer insulating layer simultaneously with the removal of the inner and outer dummy patterns.

In the present invention, it is preferable that the coil part has three or more conductor layers and that the step of forming an intermediate conductor layer of the plurality of conductor layers positioned between the lowermost and uppermost layers includes a step of forming the seed layer including the coil pattern, inner auxiliary pattern, and outer auxiliary pattern. As described above, a terminal pattern is not formed in the spiral pattern included in the intermediate conductor layer, making it difficult to supply power not only to the inner dummy pattern, but also to the spiral pattern. However, when both the inner auxiliary pattern and the outer auxiliary pattern are provided for the spiral pattern included in the intermediate conductor layer, power can easily be supplied to the inner dummy pattern and spiral pattern.

In the present invention, the step of forming the lowermost conductor layers and the step of forming the uppermost conductor layers preferably include a step of forming the seed layer that includes the coil pattern and inner auxiliary pattern and does not include the outer auxiliary pattern. As described above, a terminal pattern is formed at the outer peripheral end of the spiral pattern included in each of the uppermost and lowermost conductor layers, so that power supply to the spiral pattern can be achieved using the terminal pattern, and power supply to the inner dummy pattern can be achieved using the inner auxiliary pattern.

In the present invention, it is preferable that the first sealing resin layer is a magnetic resin layer containing metal magnetic particles and resin binder and that only the resin binder is embedded in the recessed part. Thus, it is possible to improve coil characteristics while securing insulating performance of the coil part.

The coil component manufacturing method according to the present invention preferably includes the steps of: preparing a carrier substrate on one main surface of which an insulating resin layer is formed and forming the coil part on the insulating resin layer; forming the first sealing resin layer so as to cover the coil part from the one main surface side of the carrier substrate; peeling the carrier substrate from the insulating resin layer; and forming a second sealing resin layer on the insulating resin layer. With this configuration, it is possible to easily manufacture a coil component having a sealing resin layer that embeds therein a coil pattern.

According to the present invention, there can be provided a coil component capable of preventing the occurrence of peeling between the coil part and a sealing resin layer around the coil part, such as the magnetic resin layer, and a manufacturing method therefor.

BRIEF DESCRIPTION OF THE DRAWINGS

The above and other objects, features and advantages of this invention will become more apparent by reference to the following detailed description of the invention taken in conjunction with the accompanying drawings:

FIGS. 4A to 4C are views for explaining the manufacturing method for the coil component 10, wherein FIG. 4A is a schematic plan view, FIG. 4B is a cross-sectional view taken along line $X_1$-$X_1$ in FIG. 4A, and FIG. 4C is a cross-sectional view taken along line $X_2$-$X_2$ in FIG. 4A;

FIGS. 5A to 5C are views for explaining the manufacturing method for the coil component 10, wherein FIG. 5A is a schematic plan view, FIG. 5B is a cross-sectional view taken along line $X_1$-$X_1$ in FIG. 5A, and FIG. 5C is a cross-sectional view taken along line $X_2$-$X_2$ in FIG. 5A;

FIGS. 6A to 6C are views for explaining the manufacturing method for the coil component 10, wherein FIG. 6A is a schematic plan view, FIG. 6B is a cross-sectional view taken along line $X_1$-$X_1$ in FIG. 6A, and FIG. 6C is a cross-sectional view taken along line $X_2$-$X_2$ in FIG. 6A;

FIGS. 7A to 7C are views for explaining the manufacturing method for the coil component 10, wherein FIG. 7A is a schematic plan view, FIG. 7B is a cross-sectional view taken along line $X_1$-$X_1$ in FIG. 7A, and FIG. 7C is a cross-sectional view taken along line $X_2$-$X_2$ in FIG. 7A;

FIGS. 8A to 8C are views for explaining the manufacturing method for the coil component 10, wherein FIG. 8A is a schematic plan view, FIG. 8B is a cross-sectional view taken along line $X_1$-$X_1$ in FIG. 8A, and FIG. 8C is a cross-sectional view taken along line $X_2$-$X_2$ in FIG. 8A;

FIGS. 9A to 9C are views for explaining the manufacturing method for the coil component 10, wherein FIG. 9A is a schematic plan view, FIG. 9B is a cross-sectional view taken along line $X_1$-$X_1$ in FIG. 9A, and FIG. 9C is a cross-sectional view taken along line $X_2$-$X_2$ in FIG. 9A;

FIGS. 10A to 10C are views for explaining the manufacturing method for the coil component 10, wherein FIG. 10A is a schematic plan view, FIG. 10B is a cross-sectional view taken along line $X_1$-$X_1$ in FIG. 10A, and FIG. 10C is a cross-sectional view taken along line $X_2$-$X_2$ in FIG. 10A;

FIGS. 11A to 11C are views for explaining the manufacturing method for the coil component 10, wherein FIG. 11A is a schematic plan view, FIG. 11B is a cross-sectional view taken along line $X_1$-$X_1$ in FIG. 11A, and FIG. 11C is a cross-sectional view taken along line $X_2$-$X_2$ in FIG. 11A;

FIGS. 12A to 12C are views for explaining the manufacturing method for the coil component 10, wherein FIG. 12A is a schematic plan view, FIG. 12B is a cross-sectional view taken along line $X_1$-$X_1$ in FIG. 12A, and FIG. 12C is a cross-sectional view taken along line $X_2$-$X_2$ in FIG. 12A;

FIGS. 13A to 13C are views for explaining the manufacturing method for the coil component 10, wherein FIG. 13A is a schematic plan view, FIG. 13B is a cross-sectional view taken along line $X_1$-$X_1$ in FIG. 13A, and FIG. 13C is a cross-sectional view taken along line $X_2$-$X_2$ in FIG. 13A;

FIGS. 14A and 14B are views for explaining the manufacturing method for the coil component 10, wherein FIG. 14A is a cross-sectional view corresponding to the position of line $X_1$-$X_1$ in FIG. 4A, etc., and FIG. 14B is a cross-sectional view corresponding to the position of line $X_2$-$X_2$ in FIG. 4A, etc.;

DETAILED DESCRIPTION OF THE EMBODIMENTS

Preferred embodiments of the present invention will be described in detail with reference to the accompanying drawings.

Figure 1:
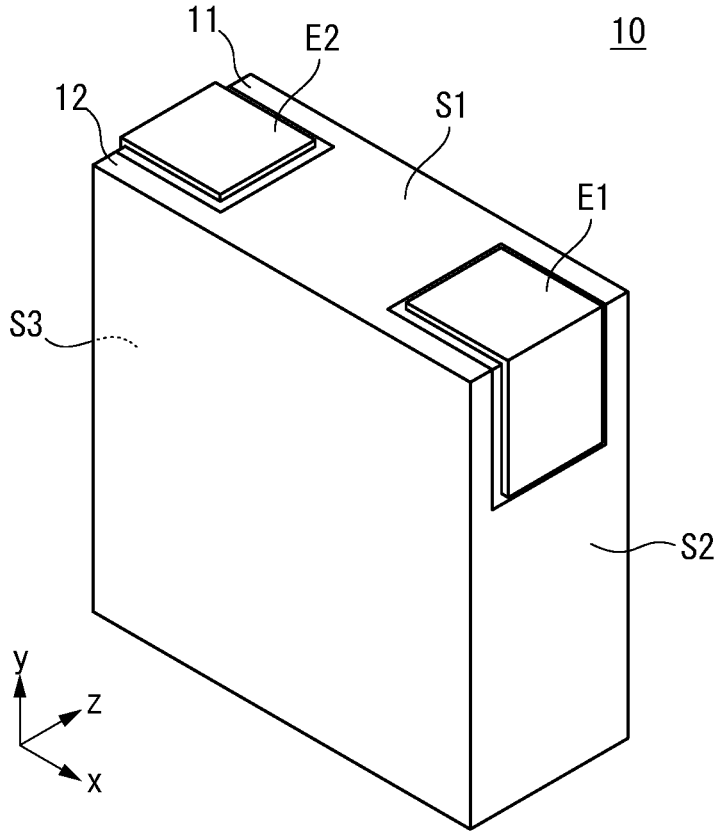
FIG. 1 is a perspective view illustrating the outer appearance of a coil component according to a preferred embodiment of the present invention.

FIG. 1 is a perspective view illustrating the outer appearance of a coil component according to a preferred embodiment of the present invention.

A coil component 10 according to the present embodiment is a surface-mount type chip component suitably used as an inductor for a power supply circuit and has first and second magnetic resin layers 11 and 12 as illustrated in FIG. 1. A coil pattern to be described later is embedded in the first and second magnetic resin layers 11 and 12. One end of the coil pattern is connected to a first external terminal E1, and the other end thereof is connected to a second external terminal E2. The coil component according to the present embodiment may not necessarily be the surface-mount type chip component but may be a chip component of a type embedded in a circuit board.

The first and second magnetic resin layers 11 and 12 are each a composite member made of resin containing metal magnetic particles and constitute a magnetic path for magnetic flux generated by making current flow in the coil pattern. As the metal magnetic particles, a permalloy-based material is preferably used. As the resin, semi-cured epoxy resin of liquid or powder is preferably used. The first and second magnetic resin layers 11 and 12 may be made of the same material or different materials. In the former case, material cost can be reduced.

Unlike common laminated coil components, the coil component 10 according to the present embodiment is vertically mounted such that the z-direction that is the lamination direction is parallel to a circuit board. Specifically, a surface constituting the xz plane is used as a mounting surface S1. On the mounting surface S1, the first and second external terminals E1 and E2 are provided. The first external terminal E1 is continuously formed from the mounting surface S1 to a side surface S2 constituting the yz plane, and the second external terminal E2 is continuously formed from the mounting surface S1 to a side surface S3 constituting the yz plane.

Figure 2A:
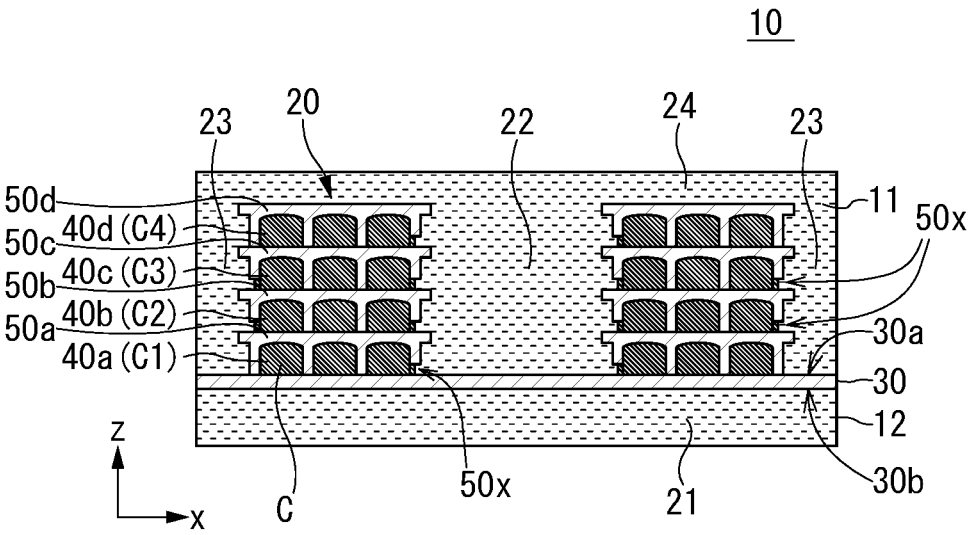
FIGS. 2A and 2B are each a cross-sectional side view illustrating the structure of the coil component 10 according to the present embodiment.
Figure 2B:
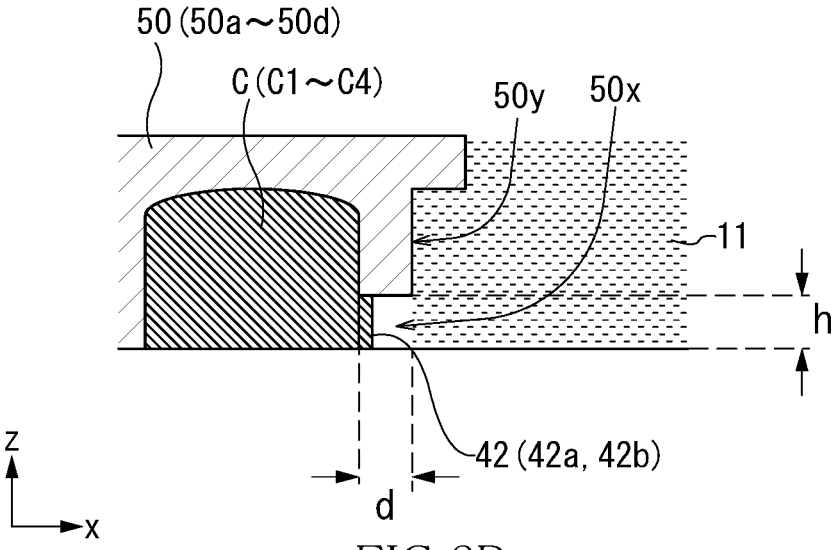
Figures 3A, 3B, 3C, 3D:
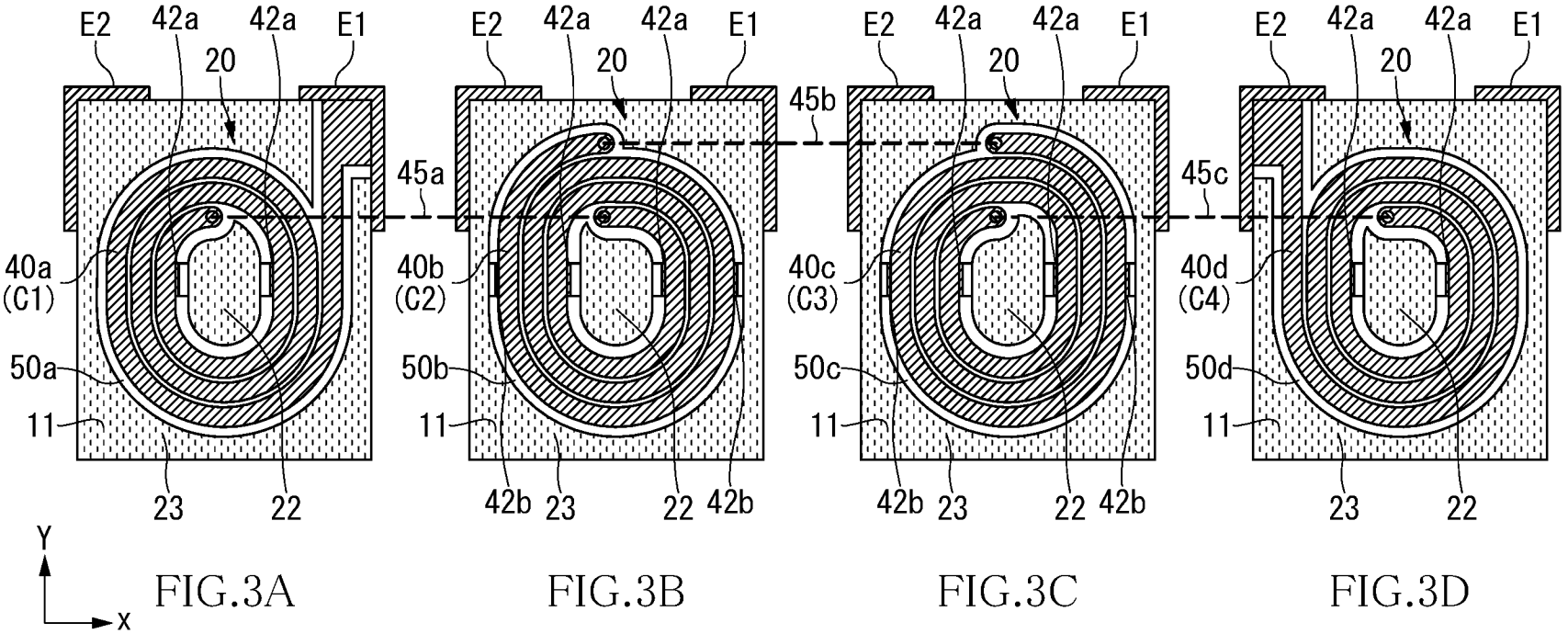
FIGS. 3A to 3D are plan layout views of the conductor layers of the coil part 20 having a four-layer structure.

FIGS. 2A and 2B are each a cross-sectional side view illustrating the structure of the coil component 10 according to the present embodiment. FIG. 2A illustrates the entire structure, and FIG. 2B illustrates a part of the structure illustrated in FIG. 2A in an enlarged manner.

As illustrated in FIGS. 2A and 2B, a coil part 20 is embedded inside the laminated body of the first and second magnetic resin layers 11 and 12. The coil part 20 has four conductor layers 40*a* to 40*d* having spiral patterns C1 to C4, respectively. Each of the spiral patterns C1 to C4 has about three turns. Thus, the total number of turns of the coil pattern C is about 12. The surfaces of the spiral patterns C1 to C4 of the conductor layers 40*a* to 40*d* are covered with an insulating gap layer 30 and interlayer insulating layers 50*a* to 50*d*, thus preventing the coil pattern C from contacting the first and second magnetic resin layers 11 and 12.

The first magnetic resin layer 11 covers the coil part 20 from one side in the coil axis direction (z-direction) and is provided in an inner diameter area 22 surrounded by the coil part 20, an outer peripheral area 23 surrounding the coil part 20, and an upper area 24 on one side of the coil part 20 in the coil axis direction. On the other hand, the second magnetic resin layer 12 covers the coil part 20 from the other side in the coil axis direction (z-direction) and is provided in a lower area 21 on the other side of the coil part 20 in the coil axis direction.

The insulating gap layer 30 (insulating resin layer) is provided between the first magnetic resin layer 11 and the second magnetic resin layer 12. The insulating gap layer 30 is made of a non-magnetic material such as resin and has a role of preventing magnetic saturation by forming a magnetic gap between the first magnetic resin layer 11 and the second magnetic resin layer 12. The first magnetic resin layer 11 is positioned on the side of a front surface 30*a* of the insulating gap layer 30, and the second magnetic resin layer 12 is positioned on the side of a back surface 30*b* thereof.

As illustrated, the interlayer insulating layers 50*a* to 50*d* cover the upper and side surfaces of the spiral patterns C1 to C4, respectively, and also cover auxiliary patterns 42, and a recessed part 50*x* for exposing the side surface (end surface) of each of the auxiliary patterns 42 is formed in a side wall surface 50*y* of each of the interlayer insulating layers 50*a* to 50*d*. A height h of the recessed part 50*x* in the lamination direction of the coil part 20 is preferably 1 μm to 10 μm, and a depth d thereof is preferably 3 μm to 25 μm. The depth direction of the recessed part 50*x* refers to a direction perpendicular to the side wall surface 50*y* and parallel to the lamination surface of the coil part 20.

A part of the magnetic resin layer 11, particularly, a part of resin binder constituting the first magnetic resin layer 11 enters and filled in the recessed part 50*x*. The magnetic resin layer 11 is made of resin containing the metal magnetic particles, and the diameter of each metal magnetic particle is larger than the height of the recessed part 50*x*. This prevents the metal magnetic particles from entering the recessed part 50*x* and allows only the resin binder of the magnetic resin layer 11 to enter the recessed part 50*x*. Thus, insulation performance of the coil pattern C can be secured.

Although details will be described later, the auxiliary pattern 42 is used for securing a plating current path in an electrolytic plating process for the spiral patterns C1 to C4 and includes an inner auxiliary pattern 42*a* connected to the innermost turn of the spiral pattern and an outer auxiliary pattern 42*b* connected to the outermost turn of the spiral pattern. In the present embodiment, the inner auxiliary pattern 42*a* is connected to the innermost turn of each of the first to fourth spiral patterns C1 to C4 (first layer spiral pattern C1, second layer spiral pattern C2, third layer spiral pattern C3, fourth layer spiral pattern C4) and, thus, the recessed part 50*x* in the side wall surface on the inner peripheral side of each of the first to fourth interlayer insulating layers 50*a* to 50*d* is formed at a position from which the side surface of the inner auxiliary pattern 42*a* is exposed. The outer auxiliary pattern 42*b* is connected to the outermost turn of each of the second and third spiral patterns C2 and C3 and, thus, the recessed part 50*x* in the side wall surface on the outer peripheral side of each of the second and third interlayer insulating layers 50*b* and 50*c* is formed at a position from which the side surface of the outer auxiliary pattern 42*b* is exposed. The outer auxiliary pattern 42*b* is not connected to the outermost turn of each of the first and fourth spiral patterns C1 to C4 and, accordingly, the recessed part 50*x* for exposing the side surface of the outer auxiliary pattern 42*b* is not formed in the side wall surface on the outer peripheral side of each of the first and fourth interlayer insulating layers 50*a* and 50*d*.

As described above, the recessed part 50*x* is formed in the side wall surface of each of the interlayer insulating layers 50*a* to 50*d*, and a part of the first magnetic resin layer 11 is embedded in the recessed part 50*x*, whereby anchor effect of the first magnetic resin layer 11 can be enhanced to thereby improve adhesion between the first magnetic resin layer 11 and the interlayer insulating layers 50*a* to 50*d*.

FIGS. 3A to 3D are plan layout views of the conductor layers of the coil part 20 having a four-layer structure.

As illustrated in FIGS. 3A to 3D, the outer peripheral end of the first spiral pattern C1 of the coil part 20 is connected to the first external terminal E1. The inner peripheral end of the first spiral pattern C1 is connected to the inner peripheral end of the second spiral pattern C2 through a through hole conductor 45*a* penetrating the interlayer insulating layer 50*a*. The outer peripheral end of the second spiral pattern C2 is connected to the outer peripheral end of the third spiral pattern C3 through a through hole conductor 45*b* penetrating the interlayer insulating layer 50*b*. The inner peripheral end of the third spiral pattern C3 is connected to the outer peripheral end of the fourth spiral pattern C4 through a through hole conductor 45*c* penetrating the interlayer insulating layer 50*c*. The outer peripheral end of the fourth spiral pattern C4 is connected to the second external terminal E2. The four spiral patterns C1 to C4 are thus connected in series to constitute a single coil element.

The two small inner auxiliary patterns 42*a* protruding toward the center are formed inside the center portion in the y-direction of the innermost turn of each of the spiral patterns C1 to C4, and the two small outer auxiliary patterns 42*b* are formed outside the center portion in the y-direction of the outermost turn of each of the spiral patterns C2 and C3. As described above, the first (lowermost) and fourth (uppermost) spiral patterns C1 and C4 are connected only with the inner auxiliary pattern 42*a* and not connected with the outer auxiliary pattern 42*b*. On the other hand, the second and third (intermediate) spiral patterns C2 and C3 are connected with both the inner auxiliary pattern 42*a* and outer auxiliary pattern 42*b*. The inner auxiliary pattern 42*a* and outer auxiliary pattern 42*b* are not particularly limited in number and position.

The following describes a manufacturing method for the coil component 10 according to the present embodiment.

FIGS. 4A to 17B are views for explaining the manufacturing method for the coil component 10 according to the present embodiment. "A" of each of FIGS. 4 to 13 is a schematic plan view, "B" is a cross-sectional view taken along line $X_1$-$X_1$ in "A", and "C" is a cross-sectional view taken along line $X_2$-$X_2$ in "A". FIG. 14A is a cross-sectional view corresponding to the position of line $X_1$-$X_1$ in FIG. 4A, etc., and FIG. 14B is a cross-sectional view corresponding to the position of line $X_2$-$X_2$ in FIG. 4A, etc. "A" and "B" of each of FIGS. 15 to 17 are each a cross-sectional view corresponding to line $X_1$-$X_1$ in FIG. 4A, etc.

Figure 4A:
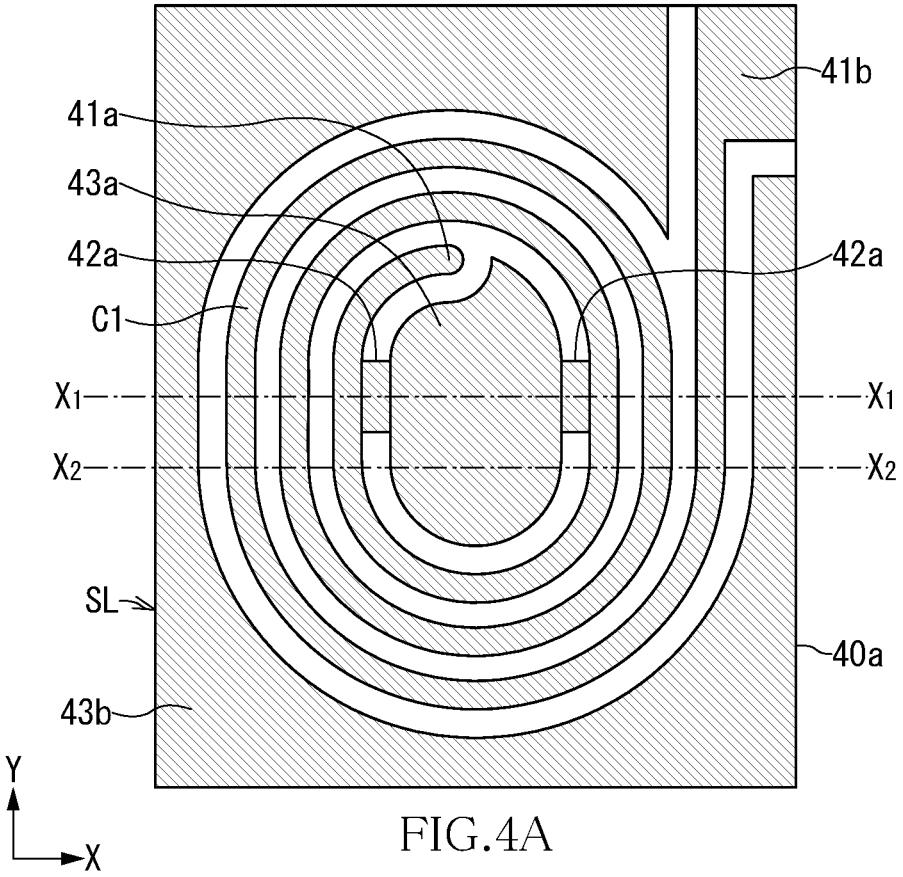
Figure 4B:
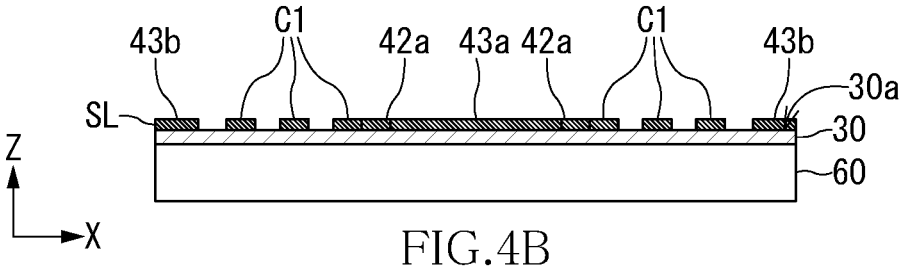
Figure 4C:
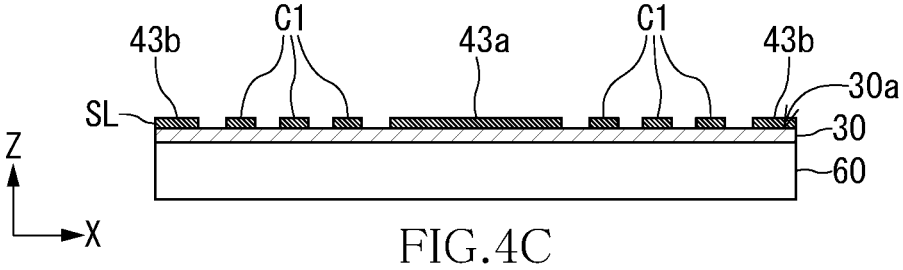

In manufacturing the coil component 10, first the insulating gap layer 30 (insulating resin layer) is formed on the upper surface of a carrier substrate 60 having a predetermined strength, as illustrated in FIGS. 4A to 4C. While a transparent glass substrate is preferably used as the material of the carrier substrate 60 in terms of easiness of peeling of an intermediate from the carrier substrate 60, a ferrite substrate, a silicon substrate, or the like may be used. Further, a formation method for the insulating gap layer 30 is also not particularly limited. Specifically, the insulating gap layer 30 may be formed by applying a resin material onto the surface of the carrier substrate 60 according to a spin coat method or a printing method or by attaching the insulating gap layer 30 previously molded into a film-like shape to the carrier substrate 60. While the following describes an example in which a single coil component is formed on the carrier substrate 60 for descriptive convenience, a mass production process in which many coil components are formed on one carrier substrate 60 is actually adopted.

Then, the first conductor layer 40*a* is formed on a first surface 30*a* (first main surface) of the insulating gap layer 30. To this end, a thin-film formation process such as sputtering or a thin copper foil is used to form a seed layer SL (seed pattern). As illustrated in FIGS. 4A to 4C, the seed layer SL includes the spiral pattern C1 having about three turns, the inner auxiliary pattern 42*a* and an inner dummy pattern 43*a* which are formed in the inner diameter area of the spiral pattern C1, and an outer dummy pattern 43*b* formed in the outer peripheral area of the spiral pattern C1. The spiral pattern C1 is wound clockwise from an outer peripheral end 41*b* toward an inner peripheral end 41*a*. The thickness of the seed layer SL is preferably 1 μm to 10 μm. When the thickness of the seed layer SL exceeds 10 μm, the top shape of the spiral pattern in cross section formed in the electrolytic plating process to be described later may be rounded, which may result in increase in the resistance value of the inductor.

The inner auxiliary pattern 42*a* is connected to a part of the innermost turn of the spiral pattern C1 to short-circuit the spiral pattern C1 and inner dummy pattern 43*a*. This allows a negative potential to be applied to the outer peripheral end and innermost turn of the spiral pattern C1 in the electrolytic plating process to be described later, whereby an electrolytic plating layer can be made uniform from the inner peripheral end to outer peripheral end of the spiral pattern C1. The outer dummy pattern 43*b* is insulated from the spiral pattern C1.

Figure 5A:
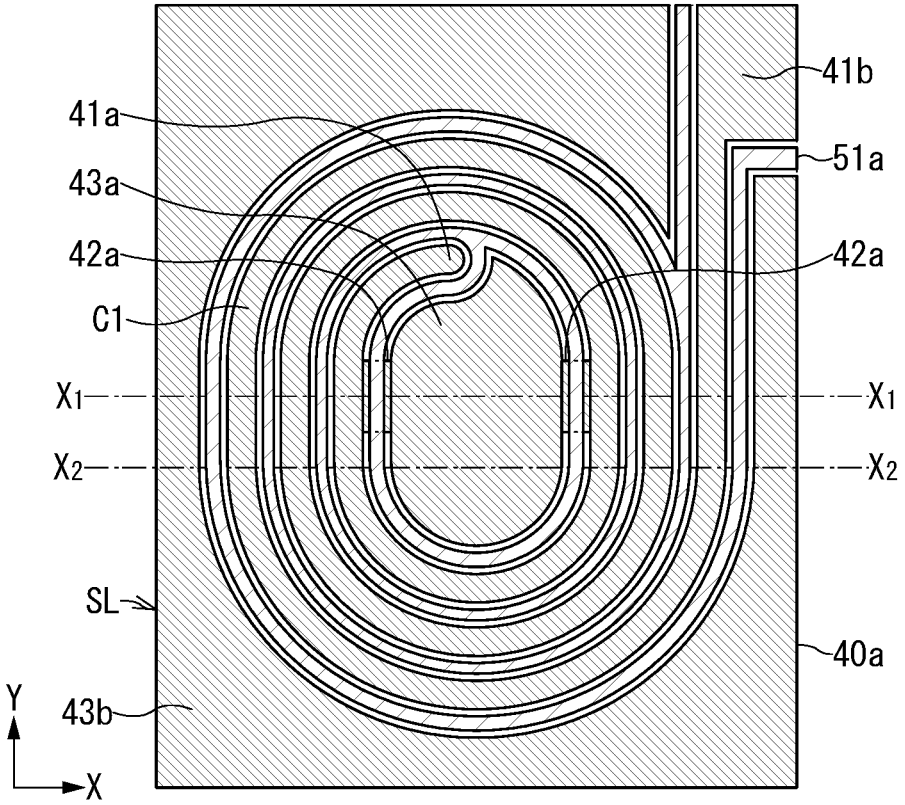
Figure 5B:
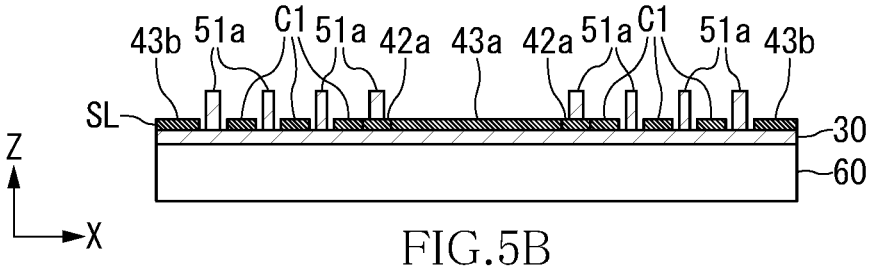
Figure 5C:
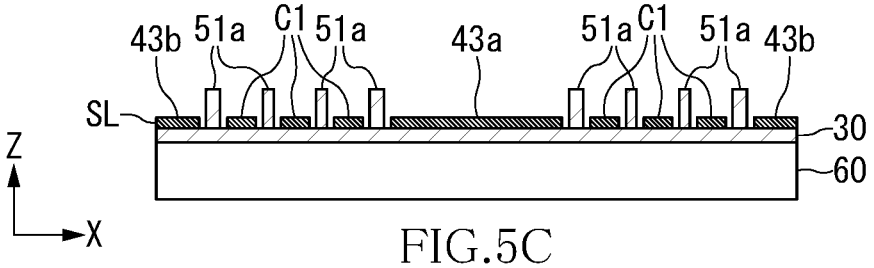

Then, as illustrated in FIGS. 5A to 5C, a photosensitive permanent resist pattern 51*a* (resist post) formed of a negative pattern of the spiral pattern C1 is formed. The inner auxiliary pattern 42*a* connected to the innermost turn of the spiral pattern C1 is covered with the resist pattern 51*a*.

Figure 6A:
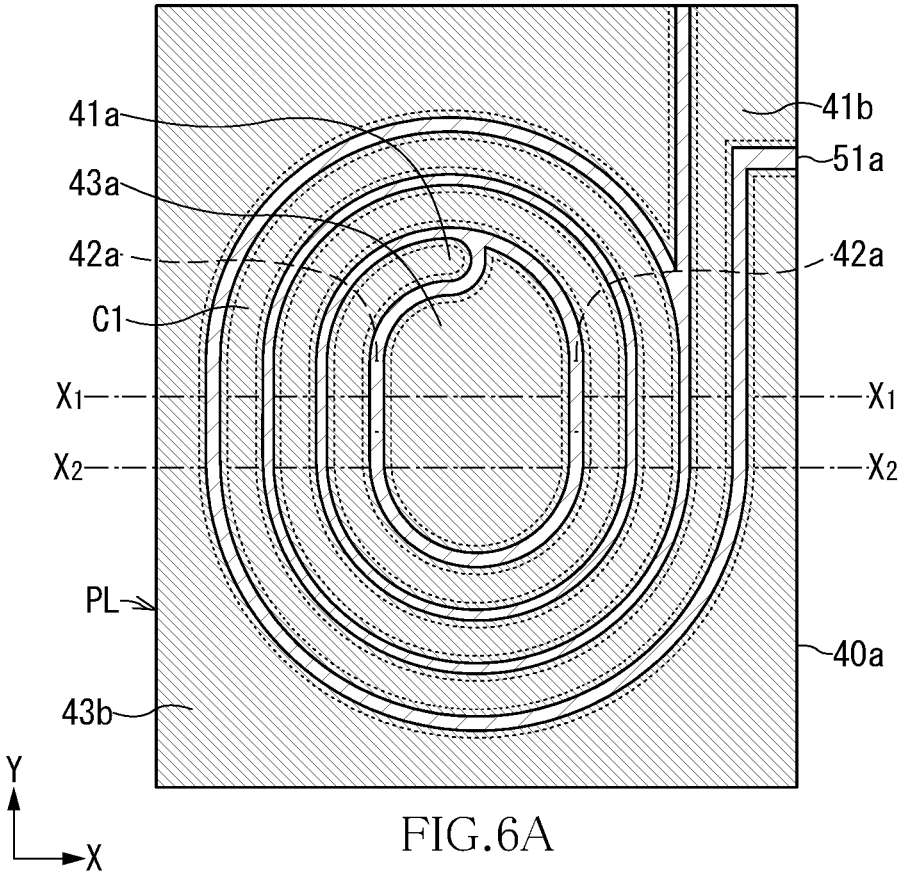
Figure 6B:
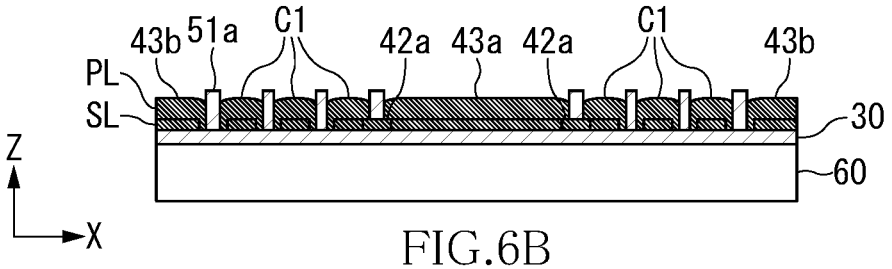
Figure 6C:
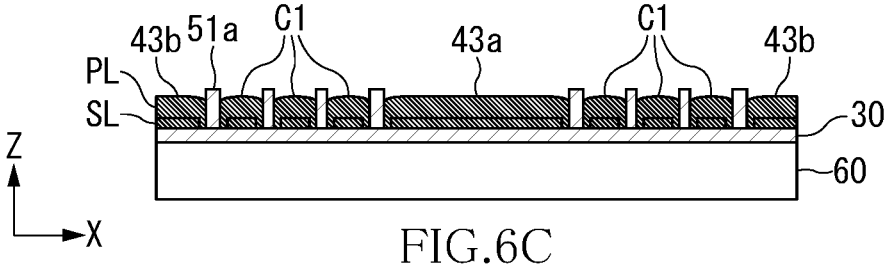

Then, as illustrated in FIGS. 6A to 6C, the seed layer SL is grown by plating to a desired film thickness by the electrolytic plating. At this time, the upper surface of the inner auxiliary pattern 42*a* is covered with the resist pattern 51*a*, so that the inner auxiliary pattern 42*a* is not grown by plating, and the thickness thereof is still equal to the thickness of the seed layer SL.

When the inner auxiliary pattern 42*a* is not formed, the inner dummy pattern 43*a* is a floating pattern insulated from the spiral pattern C1, so that the inner dummy pattern 43*a* cannot be grown by plating only by applying the negative potential to the outer peripheral end 41*b* of the spiral pattern C1 and the outer dummy pattern 43*b* in the electrolytic plating process. However, in the present embodiment, the inner auxiliary pattern 42*a* is formed in the inner diameter area of the spiral pattern C1 to short-circuit the inner dummy pattern 43*a* and the innermost turn of the spiral pattern C1, thereby allowing the inner dummy pattern 43*a* to be grown by plating, which in turn can uniformly form an electrolytic plating layer PL having a sufficient thickness on the entire plated surface.

Figure 7A:
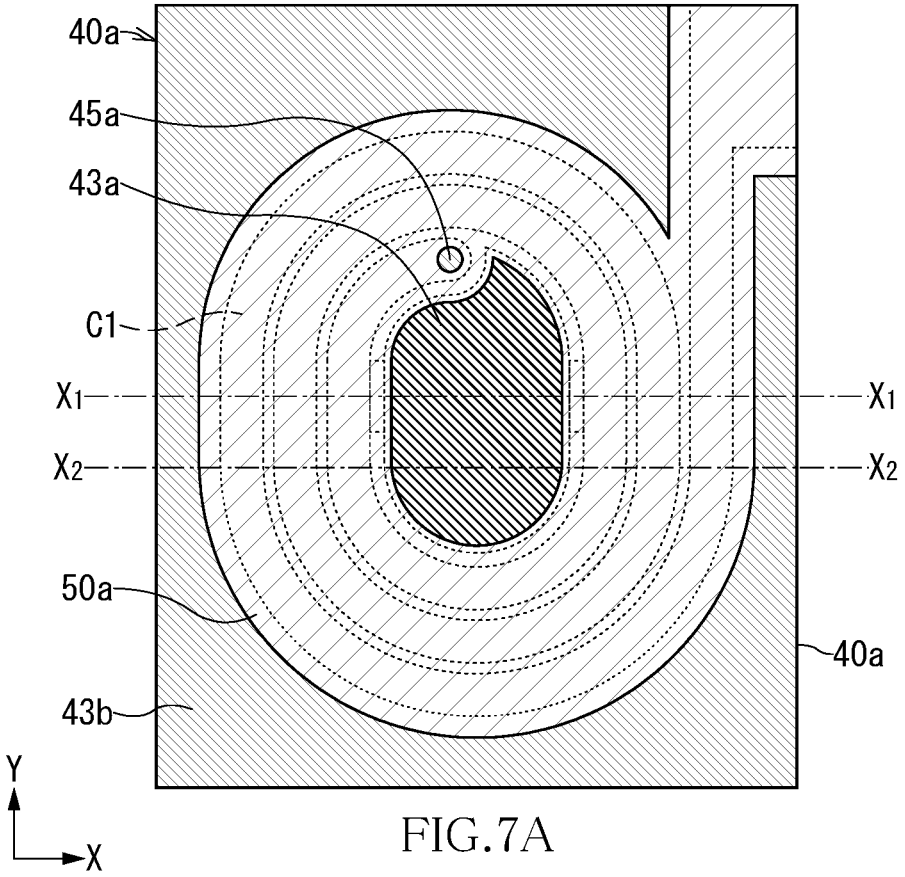
Figure 7B:
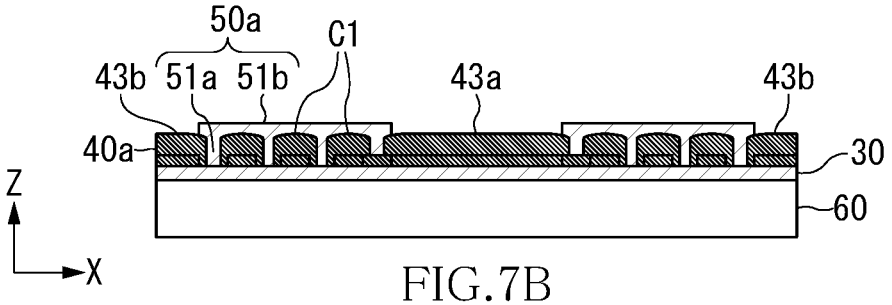
Figure 7C:
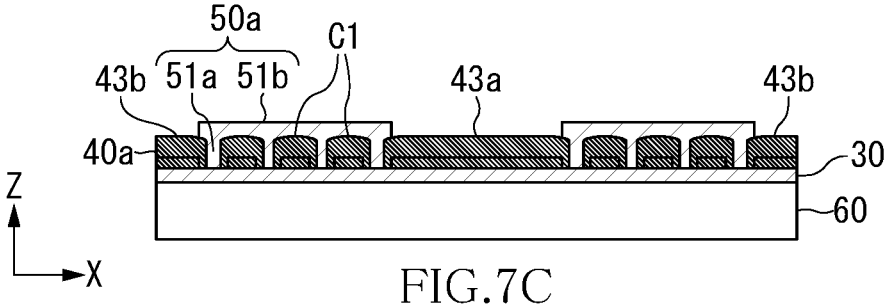

Then, the upper end portion of the resist pattern 51*a* is removed by way of, e.g., asking, to expose the head of the spiral pattern C1 and, thereafter, as illustrated in FIGS. 7A to 7C, a resist pattern 51*b* that covers the upper surface of the spiral pattern C1 is formed. In this way, the interlayer insulating layer 50*a* composed of the resist patterns 51*a* and 51*b* and surrounding the spiral pattern C1 is formed.

Thereafter, the processes from FIGS. 4A to 7C are repeated to alternately form the second to fourth conductor layers 40*b* to 40*d* and second to fourth interlayer insulating layers 50*b* to 50*d*.

Figure 8A:
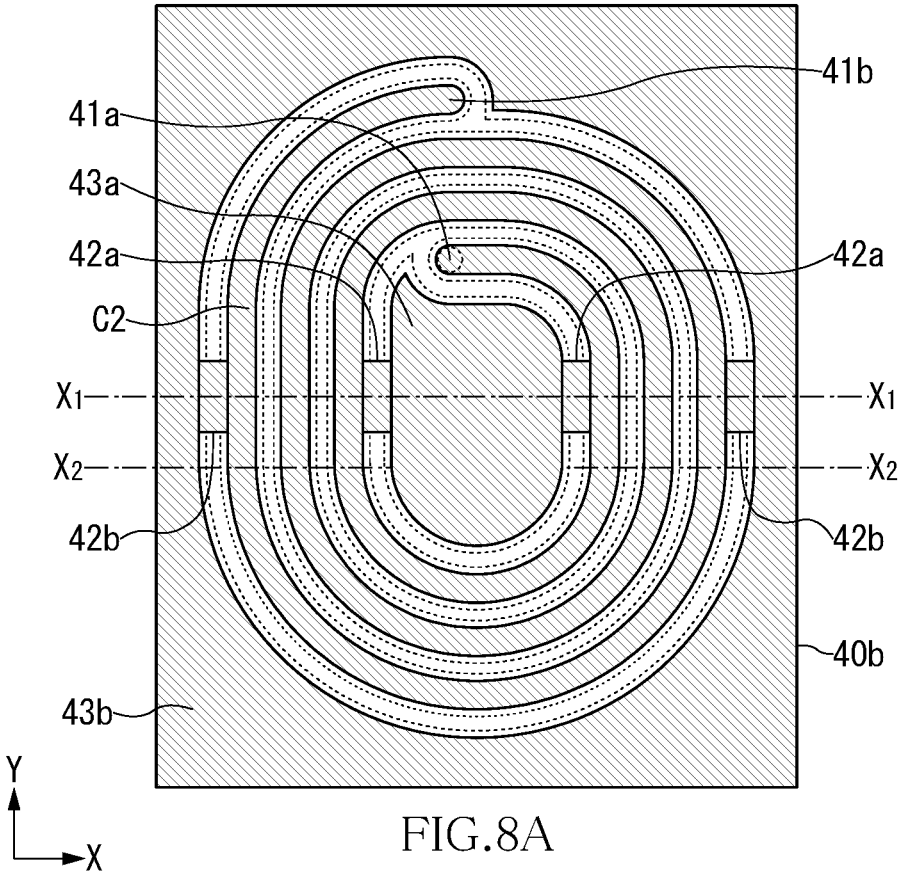
Figure 8B:
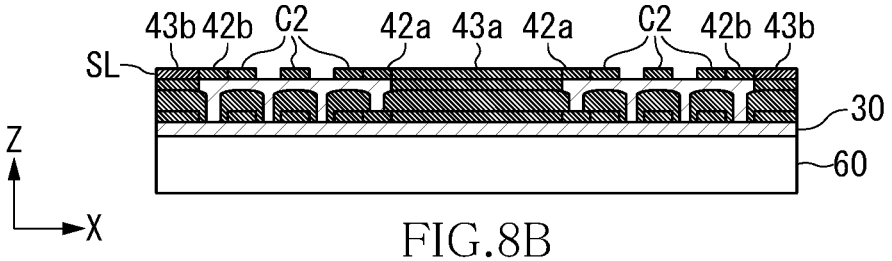
Figure 8C:
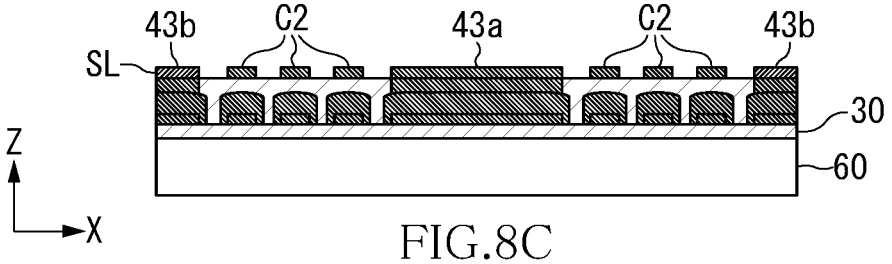

In forming the second conductor layer 40*b*, the thin-film formation process or a thin copper foil is used to form the seed layer SL (seed pattern), as illustrated in FIGS. 8A to 8C. The seed layer SL includes the spiral pattern C2 having three turns, the inner auxiliary pattern 42*a* and inner dummy pattern 43*a* which are formed in the inner diameter area of the spiral pattern C2, and the outer auxiliary pattern 42*b* and outer dummy pattern 43*b* which are formed in the outer peripheral area of the spiral pattern C2. The spiral pattern C2 is wound clockwise from the inner peripheral end toward the outer peripheral end. The inner auxiliary pattern 42*a* is connected to the innermost turn of the spiral pattern C2, and the outer auxiliary pattern 42*b* is connected to the outermost turn of the spiral pattern C2.

Figure 9A:
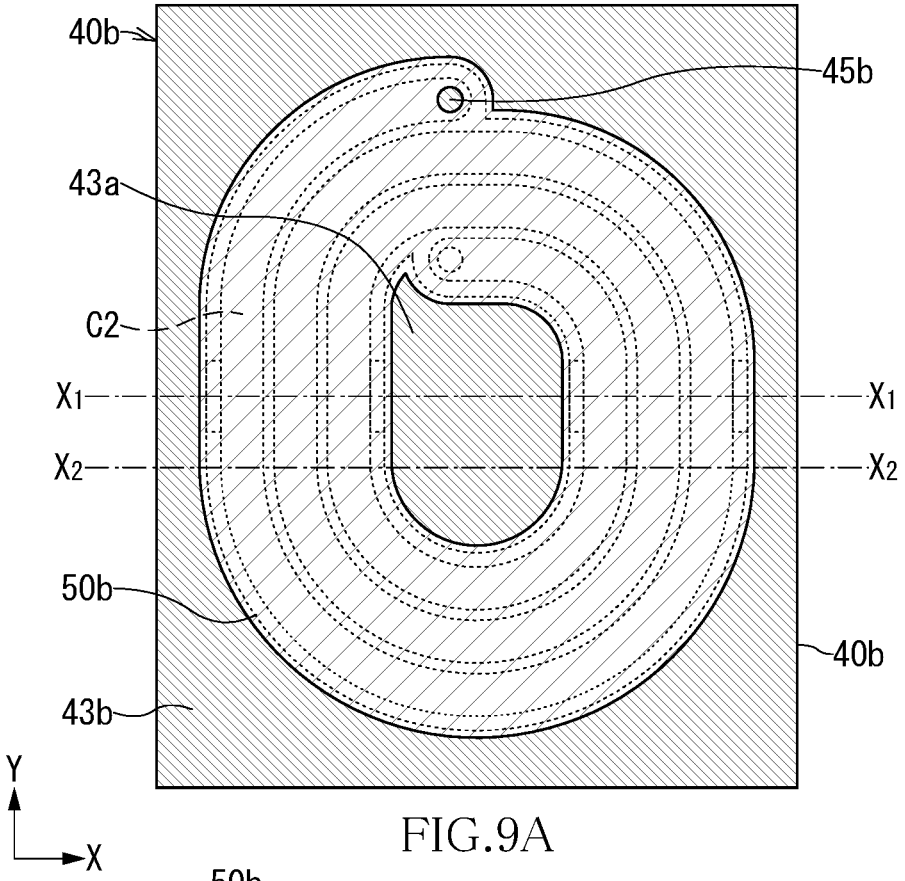
Figure 9B:
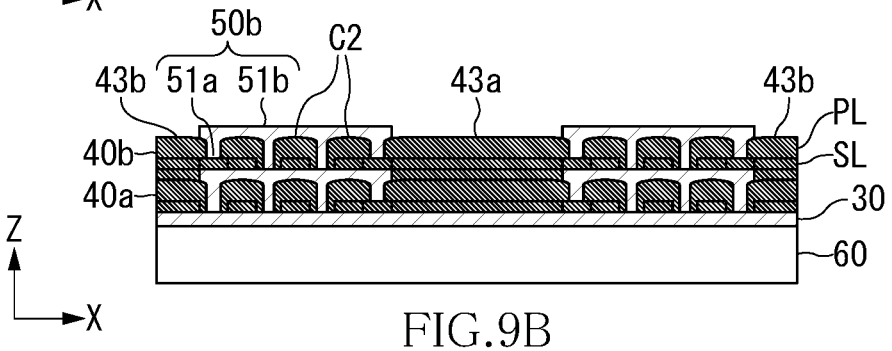
Figure 9C:
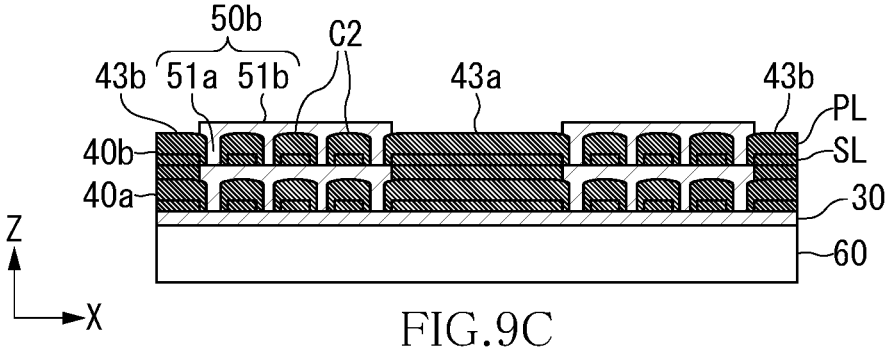

Thereafter, as illustrated in FIGS. 9A to 9C, the photosensitive permanent resist pattern 51*a* (resist post), electrolytic plating layer PL, and resist pattern 51*b* are sequentially formed in this order. The upper surfaces of the respective inner auxiliary pattern 42*a* and outer auxiliary pattern 42*b* are covered with the resist pattern 51*a*, so that the inner auxiliary pattern 42*a* and outer auxiliary pattern 42*b* are not grown by plating at the formation of the electrolytic plating layer PL.

When the inner auxiliary pattern 42*a* and outer auxiliary pattern 42*b* are not formed, the inner dummy pattern 43*a* and spiral pattern C2 are floating patterns insulated from the outer dummy pattern 43*b*, so that the inner dummy pattern 43*a* and spiral pattern C2 cannot be grown by plating only by applying the negative potential to the outer dummy pattern 43*b* in the electrolytic plating process. However, in the present embodiment, the inner auxiliary pattern 42*a* and outer auxiliary pattern 42*b* are formed in the inner diameter area and outer peripheral area of the spiral pattern C2, respectively, to short-circuit the inner dummy pattern 43*a* and the innermost turn of the spiral pattern C2 and short-circuit the outer dummy pattern 43*b* and the outermost turn of the spiral pattern C2, thereby allowing the spiral pattern C2 and inner dummy pattern 43*a* to be grown by plating, which in turn can uniformly form the electrolytic plating layer PL having a sufficient thickness on the entire plated surface. Thus, the spiral pattern C2 having a uniform thickness over the entire length thereof can be formed.

Figure 10A:
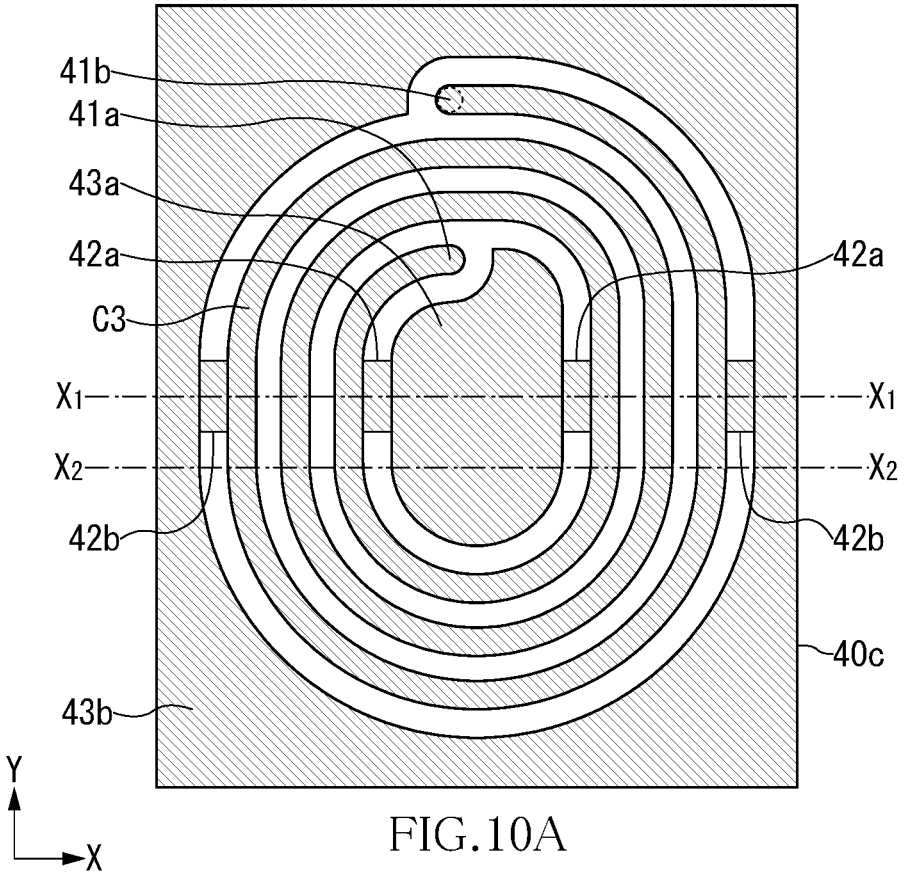
Figure 10B:
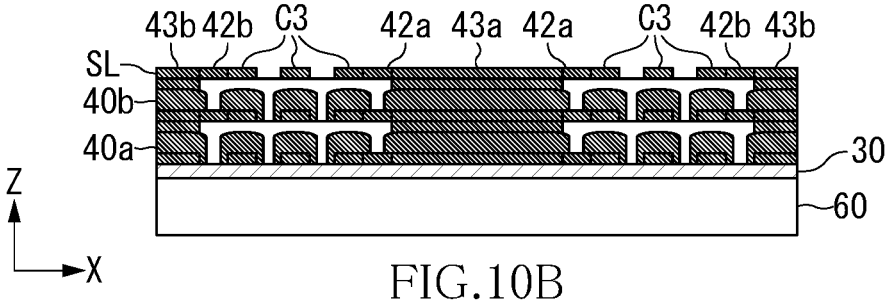
Figure 10C:
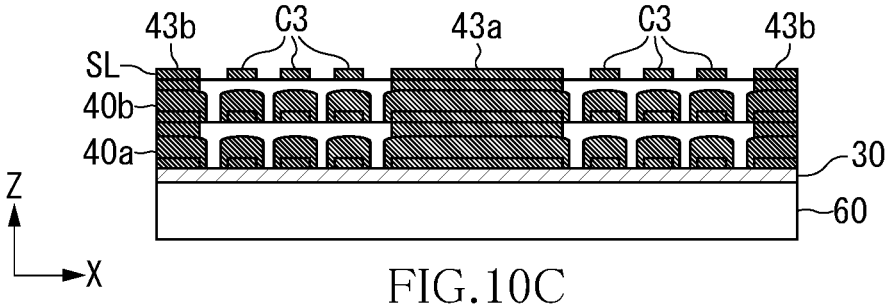

In forming the third conductor layer 40*c*, the thin-film formation process or a thin copper foil is used to form the seed layer SL (seed pattern), as illustrated in FIGS. 10A to 10C. The seed layer SL includes the spiral pattern C3 having three turns, the inner auxiliary pattern 42*a* and inner dummy pattern 43*a* which are formed in the inner diameter area of the spiral pattern C3, and the outer auxiliary pattern 42*b* and outer dummy pattern 43*b* which are formed in the outer peripheral area of the spiral pattern C3. The spiral pattern C3 is wound clockwise from the outer peripheral end 41*b* toward the inner peripheral end 41*a*. The inner auxiliary pattern 42*a* is connected to the innermost turn of the spiral pattern C3, and the outer auxiliary pattern 42*b* is connected to the outermost turn of the spiral pattern C3.

Figure 11A:
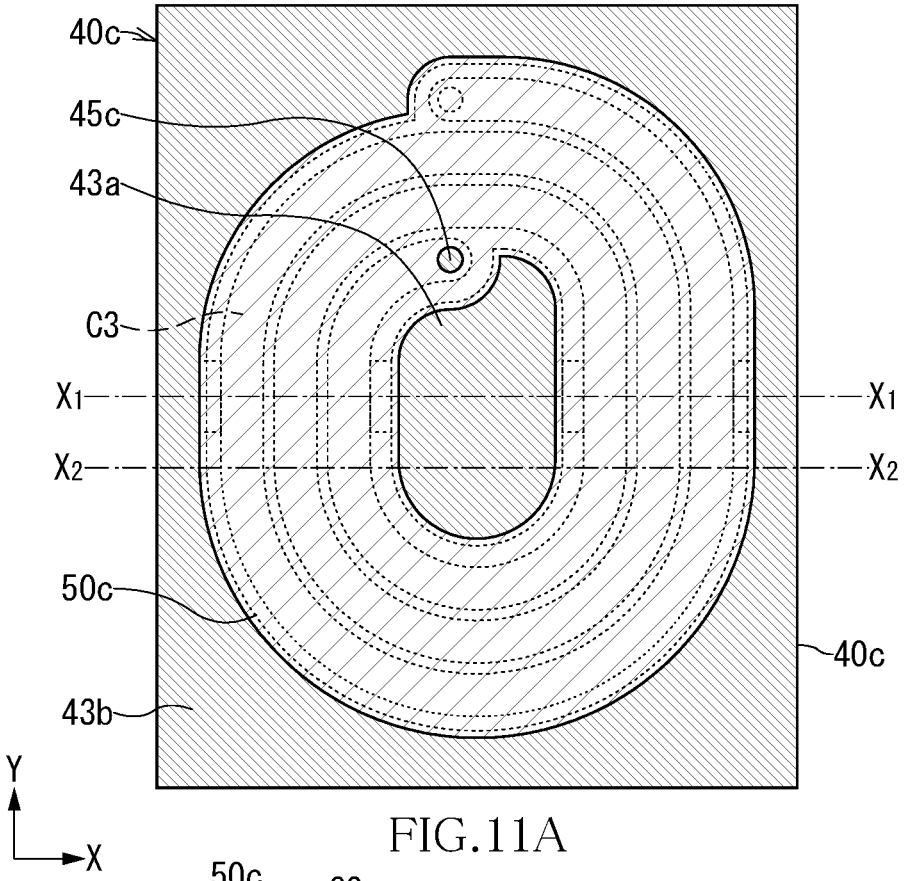
Figure 11B:
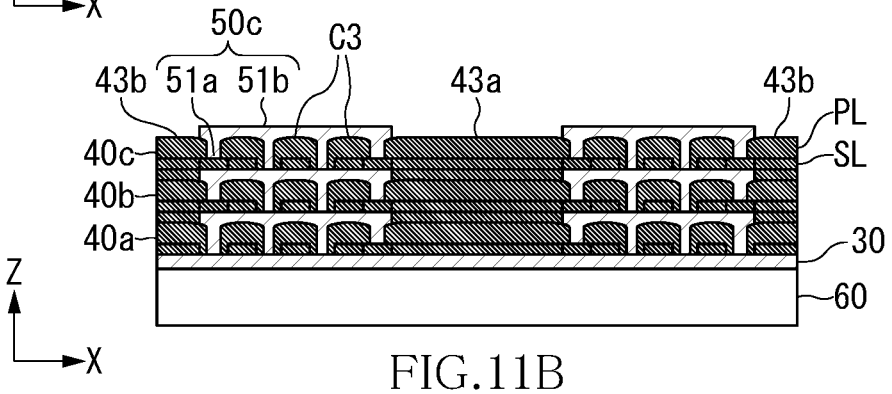
Figure 11C:
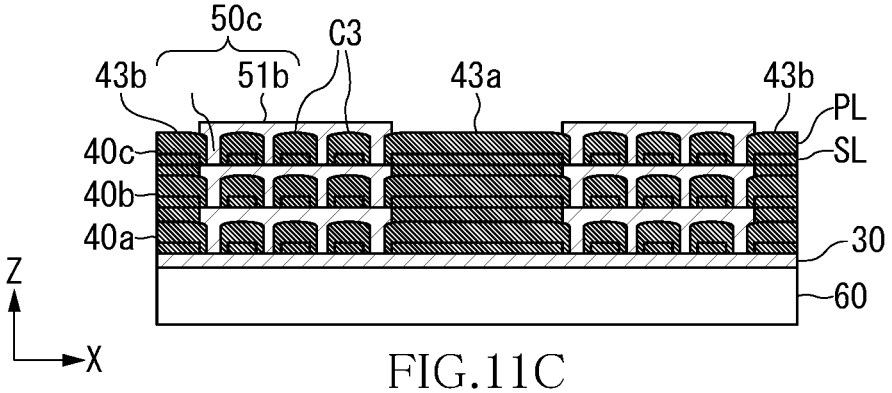

Thereafter, as illustrated in FIGS. 11A to 11C, the photosensitive permanent resist pattern 51*a* (resist post), electrolytic plating layer PL, and resist pattern 51*b* are sequentially formed in this order. The upper surfaces of the respective inner auxiliary pattern 42*a* and outer auxiliary pattern 42*b* are covered with the resist pattern 51*a*, so that the inner auxiliary pattern 42*a* and outer auxiliary pattern 42*b* are not grown by plating at the formation of the electrolytic plating layer PL.

When the inner auxiliary pattern 42*a* and outer auxiliary pattern 42*b* are not formed, the inner dummy pattern 43*a* and spiral pattern C3 are floating patterns insulated from the outer dummy pattern 43*b*, so that the inner dummy pattern 43*a* and spiral pattern C3 cannot be grown by plating only by applying the negative potential to the outer dummy pattern 43*b* in the electrolytic plating process. However, in the present embodiment, the inner auxiliary pattern 42*a* and outer auxiliary pattern 42*b* are formed in the inner diameter area and outer peripheral area of the spiral pattern C3, respectively, to short-circuit the inner dummy pattern 43*a* and the innermost turn of the spiral pattern C3 and short-circuit the outer dummy pattern 43*b* and the outermost turn of the spiral pattern C3, thereby allowing the spiral pattern C3 and inner dummy pattern 43*a* to be grown by plating, which in turn can uniformly form the electrolytic plating layer PL having a sufficient thickness on the entire plated surface. Thus, the spiral pattern C3 having a uniform thickness over the entire length thereof can be formed.

Figure 12A:
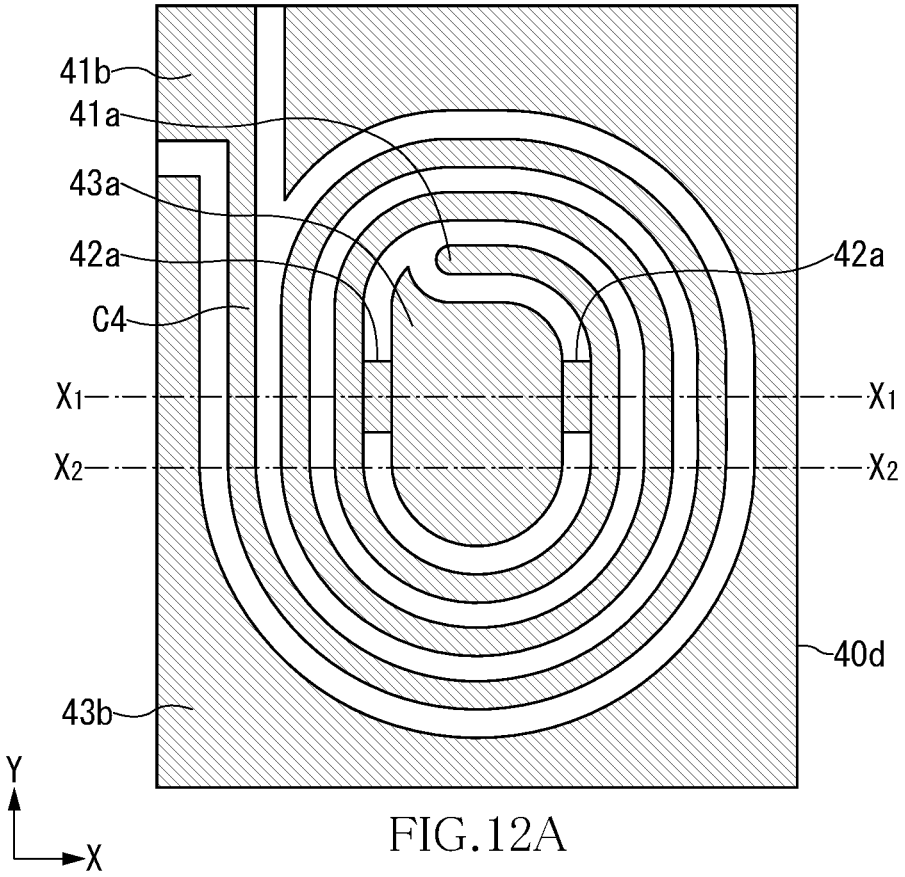
Figure 12B:
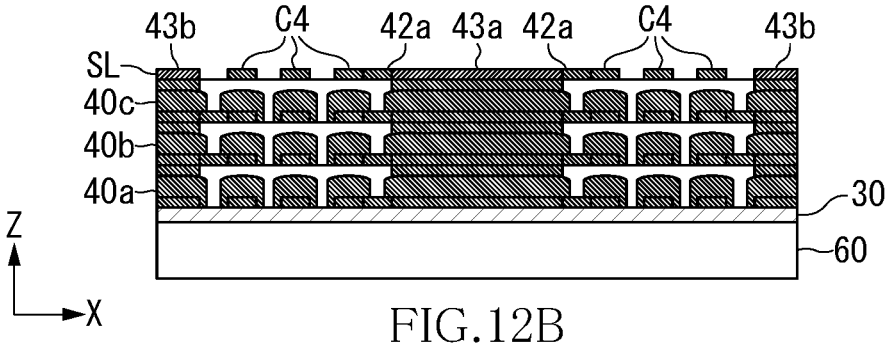
Figure 12C:
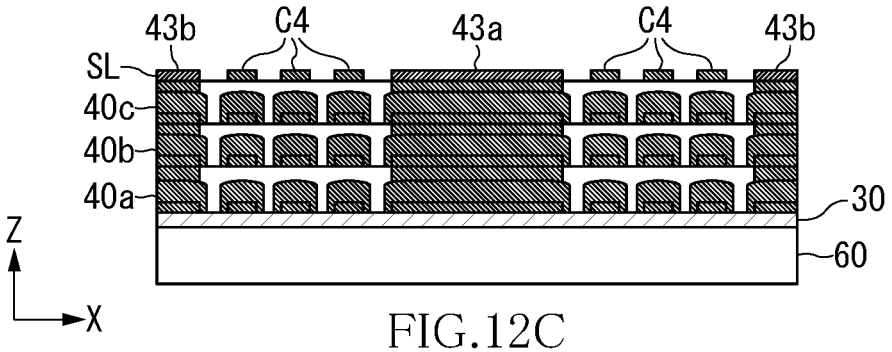

In forming the fourth conductor layer 40*d*, the thin-film formation process or a thin copper foil is used to form the seed layer SL (seed pattern), as illustrated in FIGS. 12A to 12C. The seed layer SL includes the spiral pattern C4 having three turns, the inner auxiliary pattern 42*a* and inner dummy pattern 43*a* which are formed in the inner diameter area of the spiral pattern C4, and the outer dummy pattern 43*b* formed in the outer peripheral area of the spiral pattern C4. The spiral pattern C4 is wound clockwise from the inner peripheral end 41*a* toward the outer peripheral end 41*b*. The inner auxiliary pattern 42*a* is connected to the innermost turn of the spiral pattern C4.

Figure 13A:
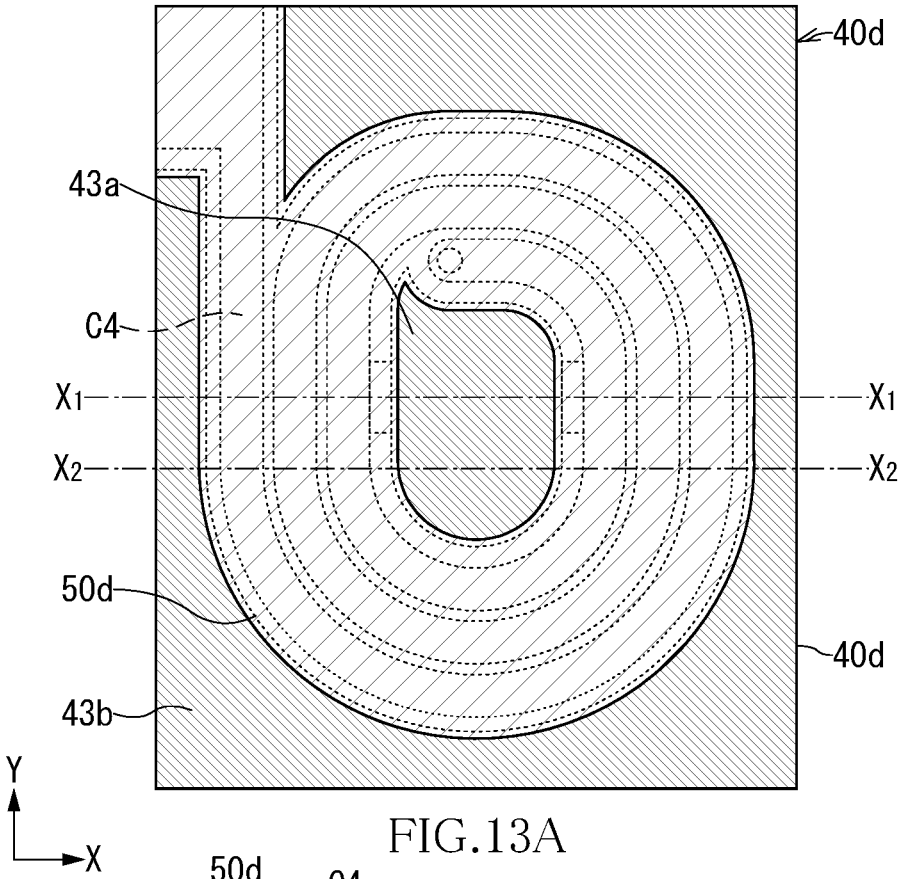
Figure 13B:
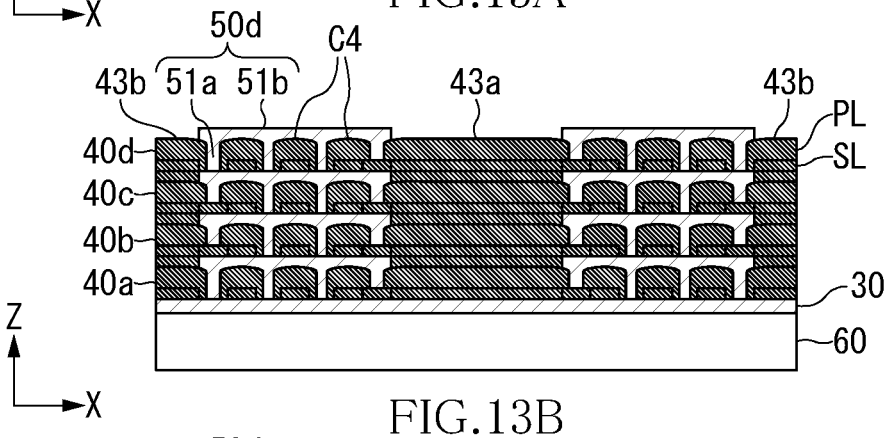
Figure 13C:
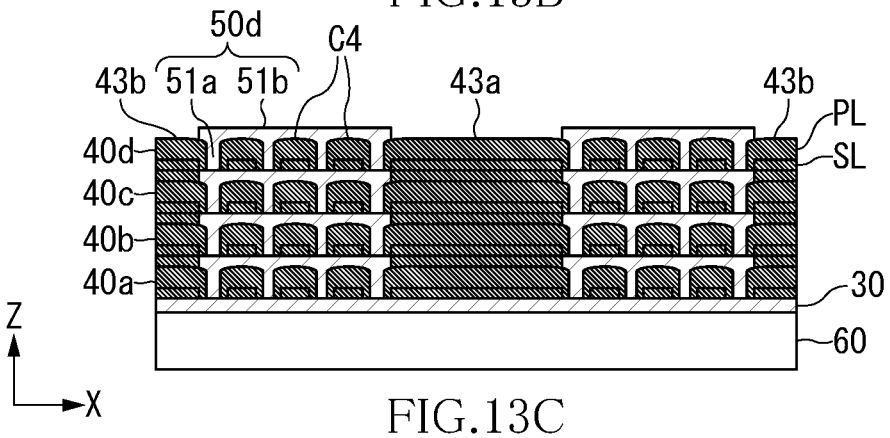
Figure 14A:
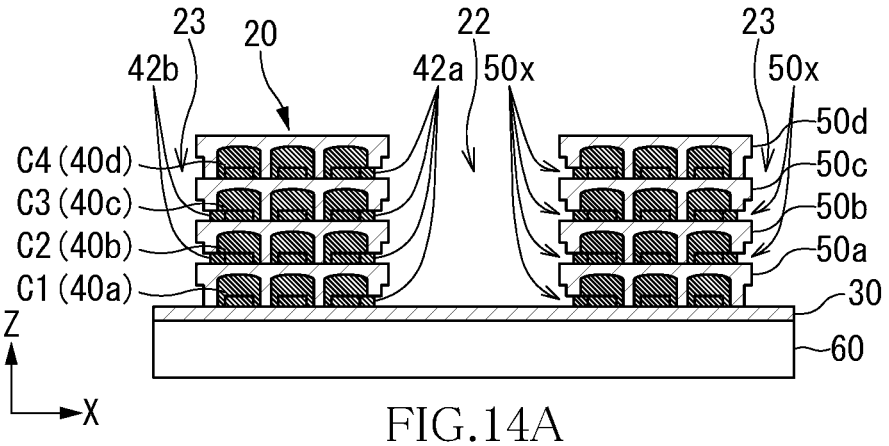
Figure 14B:
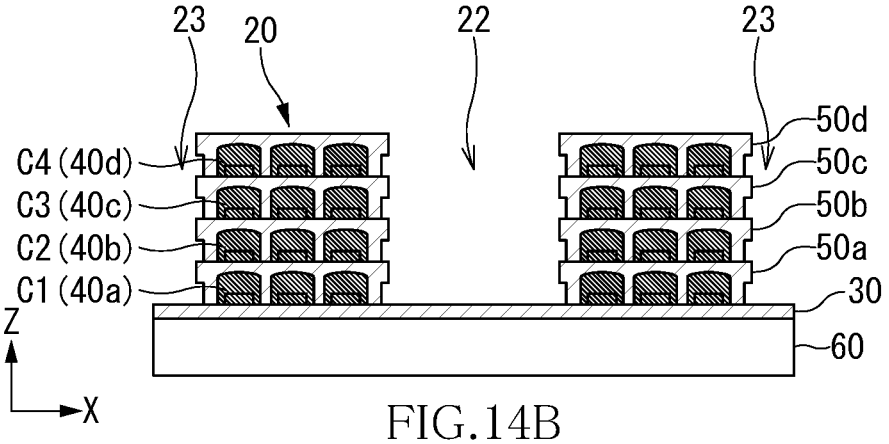

Thereafter, as illustrated in FIGS. 13A to 13C, the photosensitive permanent resist pattern 51*a* (resist post), electrolytic plating layer PL, and resist pattern 51*b* are sequentially formed in this order. The upper surface of the drawn part of the inner auxiliary pattern 42*a* and the upper surface of the outer auxiliary pattern 42*b* are covered with the resist pattern 51*a*, so that the drawn parts of the respective inner auxiliary pattern 42*a* and outer auxiliary pattern 42*b* are not grown by plating at the formation of the electrolytic plating layer PL.

When the inner auxiliary pattern 42*a* is not formed, the inner dummy pattern 43*a* is a floating pattern insulated from the spiral pattern C4, so that the inner dummy pattern 43*a* cannot be grown by plating only by applying the negative potential to the outer peripheral end 41*b* of the spiral pattern C4 and to the outer dummy pattern 43*b* in the electrolytic plating process. However, in the present embodiment, the inner auxiliary pattern 42*a* is formed in the inner diameter area of the spiral pattern C4 to short-circuit the inner dummy pattern 43*a* and the innermost turn of the spiral pattern C4, thereby allowing the inner dummy pattern 43*a* to be grown by plating, which in turn can uniformly form the electrolytic plating layer PL having a sufficient thickness on the entire plated surface. Thus, the spiral pattern C4 having a uniform thickness over the entire length thereof can be formed.

Then, as illustrated in FIGS. 14A and 14B, wet etching is performed to selectively remove the conductor layers 40*a* to 40*d* while leaving the spiral patterns C1 to C4. That is, the conductor layers 40*a* to 40*d* existing in the inner diameter area 22 and outer peripheral area 23 of the spiral patterns C1 to C4 are removed. While the spiral patterns C1 to C4 are not removed by the etching since they are covered with the interlayer insulating layers 50*a* to 50*d*, respectively, the other conductor patterns are removed by the etching. As a result, a space is formed in the inner diameter area 22 surrounded by the spiral patterns C1 to C4 and the outer peripheral area 23 positioned outside the spiral patterns C1 to C4.

In the process of selectively removing the conductor layers 40*a* to 40*d*, a part of the inner auxiliary pattern 42*a* and a part of the outer auxiliary pattern 42*b* are removed by over-etching, with the result that the recessed part 50*x* is formed in the side wall surface of the interlayer insulating layer. In the depth of the recessed part 50*x*, the exposed surface of the inner auxiliary pattern 42*a* or outer auxiliary pattern 42*b* exists.

Figure 15A:
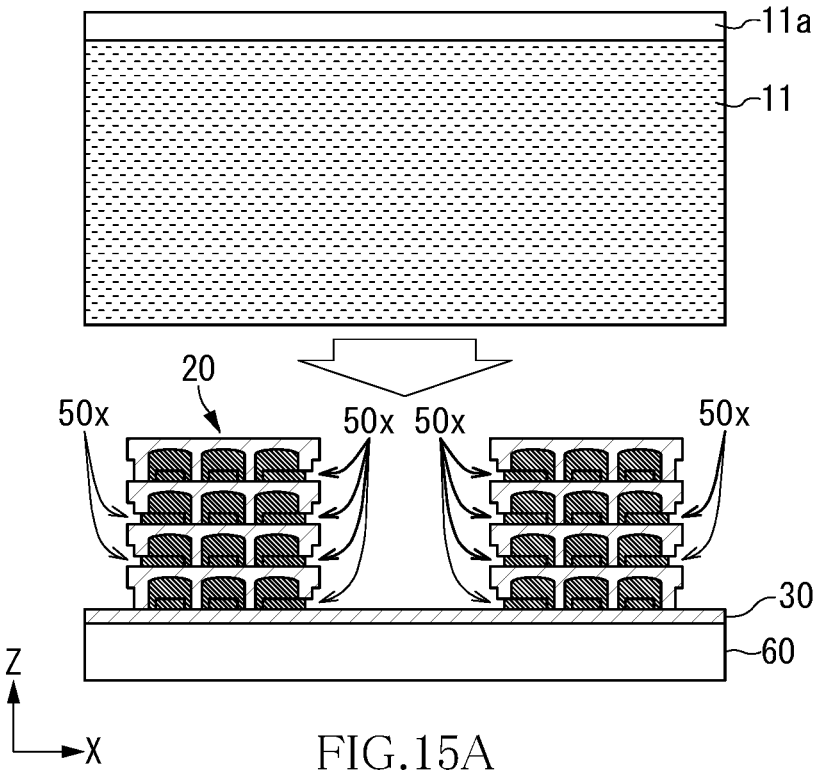
FIGS. 15A and 15B are each a cross-sectional view corresponding to line $X_1$-$X_1$ in FIG. 4A, etc.

Then, as illustrated in FIG. 15A, the first magnetic resin layer 11 in a semi-cured state retained on a film 11*a* made of PET resin is prepared and is laminated on the carrier substrate 60 with the first magnetic resin layer 11 facing the coil part 20. As a result, the first magnetic resin layer 11 is formed in the inner diameter area 22, the outer peripheral area 23, and the upper area 24 of the coil part 20. Alternatively, a composite member in a semi-cured state made of resin containing metal magnetic particles may be embedded in the space formed by the removal of the unnecessary part of the conductor layers 40*a* to 40*d* by a printing method.

Figure 15B:
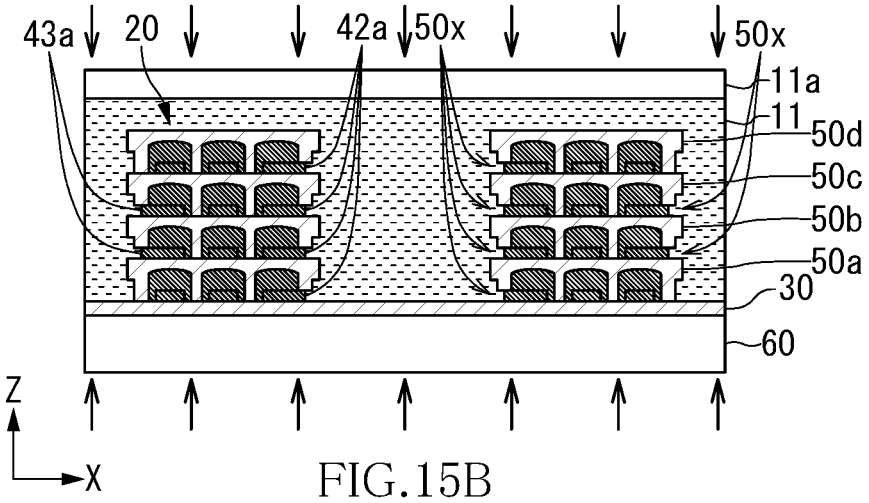

Then, as illustrated in FIG. 15B, the first magnetic resin layer 11 is pressed to completely embed a gap existing in the inner diameter area 22 and outer peripheral area 23 of the coil part 20 with the first magnetic resin layer 11. In pressing the first magnetic resin layer 11, a part of the first magnetic resin layer 11 enters the recessed part 50*x* formed in the side wall surface of each of the interlayer insulating layers 50*a* to 50*d*, so that even when the thermal expansion coefficient differs between the first magnetic resin layer 11 and the interlayer insulating layers 50*a* to 50*d*, adhesion between the first magnetic resin layer 11 and the coil part 20 can be improved by the anchor effect. Further, since the recessed part 50*x* is formed by removing the seed layer SL having a thickness as small as about 1 μm to 10 μm, the metal magnetic particles contained in the first magnetic resin layer 11 cannot enter the recessed part 50*x*, and only the resin binder can enter the recessed part 50*x*. This prevents the metal magnetic particles from contacting the auxiliary patterns 42*a* and 42*b*, allowing the insulation performance of the coil pattern to be secured.

Figure 16A:
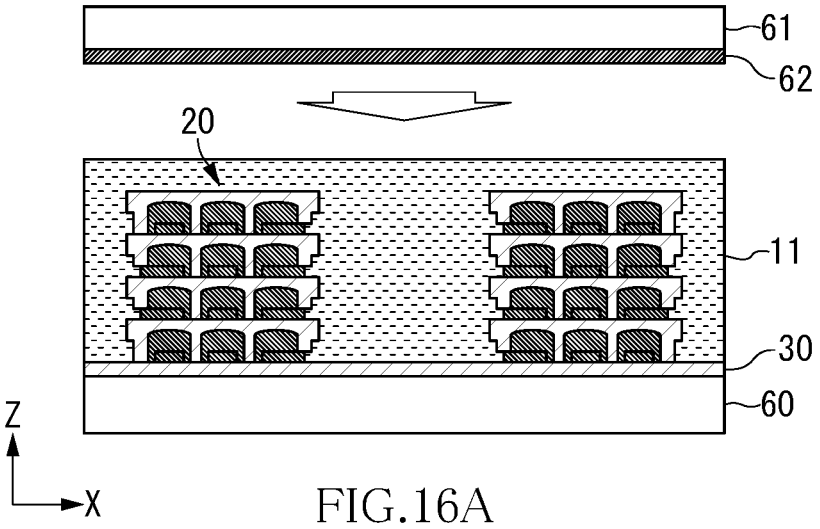
FIGS. 16A and 16B are each a cross-sectional view corresponding to line $X_1$-$X_1$ in FIG. 4A, etc.
Figure 16B:
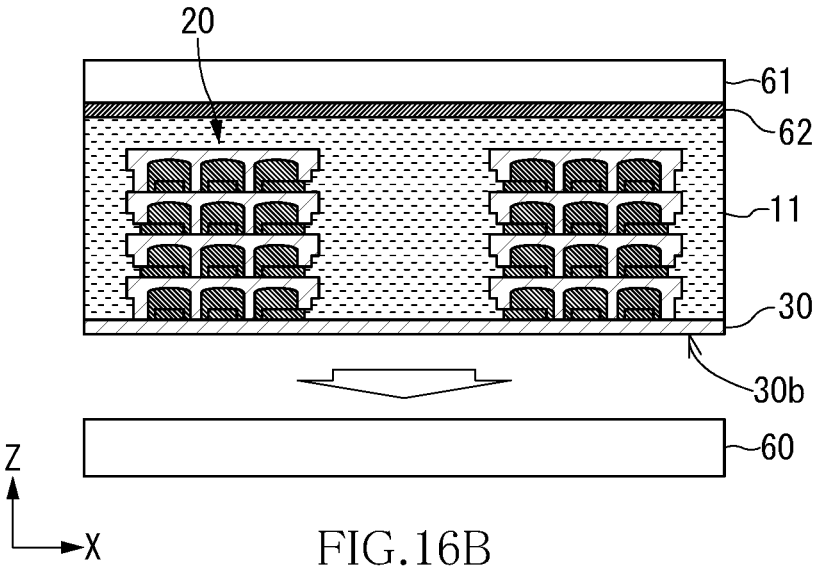

Then, as illustrated in FIG. 16A, the film 11*a* is peeled, and a support plate 61 is bonded to the first magnetic resin layer 11 by an adhesive 62. After that, as illustrated in FIG. 16B, the carrier substrate 60 is peeled. As a result, the back surface 30*b* (second main surface) of the insulating gap layer 30 is exposed. The support plate 61 is a support member provided for the peeling process of the carrier substrate 60. When it is not necessary to support the whole structure in the peeling process of the carrier substrate 60, the support plate 61 need not be bonded.

While thermal peeling by laser irradiation is preferable as a method of peeling the carrier substrate 60, the peeling may be performed mechanically. When the carrier substrate 60 is thermally peeled, a glass substrate is preferably used as the carrier substrate 60, and laser is irradiated to the insulating gap layer 30 from the back side of the carrier substrate 60. The laser light reaches the insulating gap layer 30 passing through the glass substrate to rapidly heat the insulating gap layer 30, with the result that the adhesion of the insulating gap layer 30 is lowered at the boundary with the carrier substrate 60, thus making it possible to easily peel the carrier substrate 60 from the insulating gap layer 30.

Figure 17A:
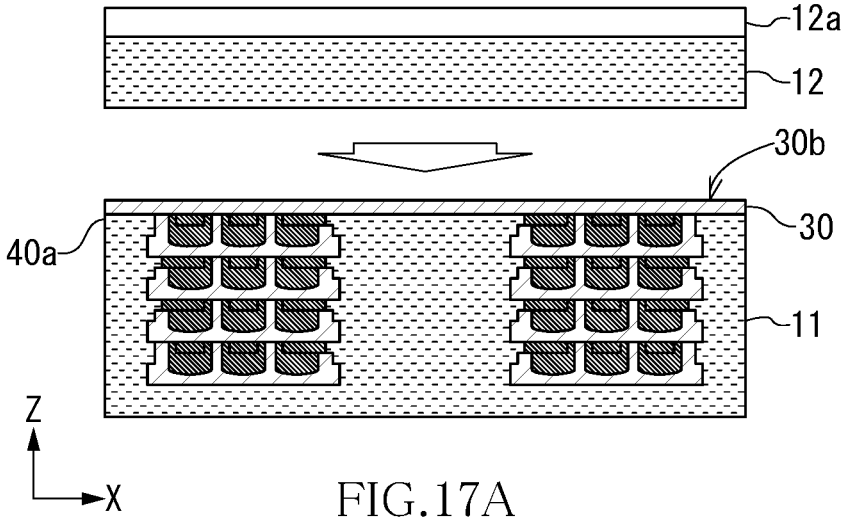
FIGS. 17A and 17B are each a cross-sectional view corresponding to line $X_1$-$X_1$ in FIG. 4A, etc.
Figure 17B:
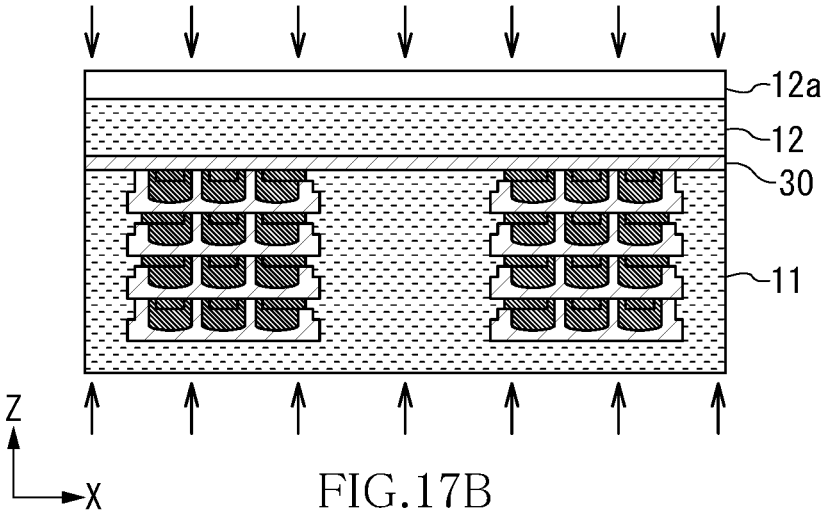

Then, as illustrated in FIG. 17A, the support plate 61 is peeled, and the intermediate is reversed up and down, followed by lamination of the second magnetic resin layer 12 in a semi-cured state retained on a film 12*a* made of PET resin on the intermediate with the second magnetic resin layer 12 facing the insulating gap layer 30. As a result, the second magnetic resin layer 12 is formed on the back surface 30*b* of the insulating gap layer 30.

Then, as illustrated in FIG. 17B, the first and second magnetic resin layers 11 and 12 are pressed and, thereafter, the first and second magnetic resin layers 11 and 12 in a semi-cured state are applied with heat or irradiated with ultraviolet ray to completely cure the first and second magnetic resin layers 11 and 12. Thereafter, the film 12*a* is peeled. Further, dicing is performed for individualization in a mass production process, followed by formation of the external terminals E1 and E2 illustrated in FIG. 1, whereby the coil component 10 according to the present embodiment is completed.

Figure 18:
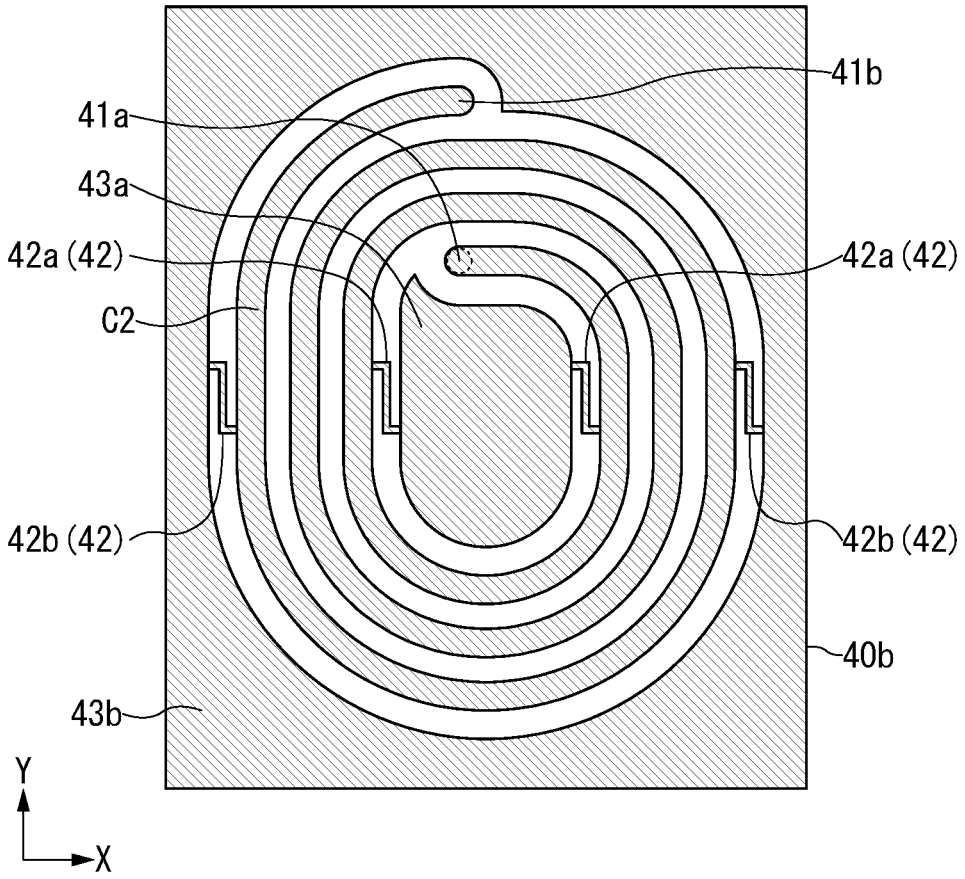
FIG. 18 is a plan view illustrating a modification of the planar shape of the auxiliary pattern.

FIG. 18 is a plan view illustrating a modification of the planar shape of the auxiliary pattern.

As illustrated in FIG. 18, in a plan view, the inner auxiliary pattern 42*a* and the outer auxiliary pattern 42*b* are each not a straight pattern extending straight from the spiral pattern C1 toward the inner dummy pattern 43*a* or outer dummy pattern 43*b* but are each a crank pattern having a bend. The number of bends is not limited, but may be any number. Thus, the auxiliary pattern 42 may be, for example, a meander pattern. Using the auxiliary pattern 42 having such a bend can increase the distance from the leading end of the auxiliary pattern 42 to the spiral pattern, thereby making it possible to avoid a situation where not only the auxiliary pattern 42 but also a part of the spiral pattern C1 is removed by over-etching.

As described above, the coil component 10 according to the present embodiment has the coil part 20 in which the first to fourth conductor layers 40*a* to 40*d* and first to fourth interlayer insulating layers 50*a* to 50*d* are alternately laminated and magnetic resin layers 11 and 12 covering the coil part 20. The first to fourth conductor layers 40*a* to 40*d* have the spiral patterns C1 to C4, respectively, and the auxiliary pattern 42 connected to the innermost turn and/or the outermost turn of each of the spiral patterns C1 to C4. The interlayer insulating layers 50*a* to 50*d* cover the upper surfaces and side surface of the respective spiral patterns C1 to C4 and also cover the upper surface of each auxiliary pattern 42. The recessed part 50*x* for exposing the side surface of the auxiliary pattern 42 is formed in the side wall surface 50*y* of each of the interlayer insulating layers 50*a* to 50*d*, and the resin binder constituting the first magnetic resin layer 11 is embedded in the recessed part 50*x*, so that it is possible to improve the adhesion between the interlayer insulating layers 50*a* to 50*d* and the magnetic resin layer by the anchor effect while securing insulation reliability of the spiral patterns C1 to C4.

Further, the manufacturing method for the coil component 10 according to the present embodiment includes: a process of forming the coil part 20 by alternately repeating a process of forming the conductor layers 40*a* to 40*d* including the spiral patterns C1 to C4, respectively, and a process of forming the interlayer insulating layers 50*a* to 50*d* covering the upper surfaces and side surfaces of the respective spiral patterns C1 to C4; and a process of forming the magnetic resin layer 11 covering the coil part 20. The process of forming the coil part 20 includes a process of forming the recessed part 50*x* in the side wall surface 50*y* of each of the interlayer insulating layers 50*a* to 50*d*. The process of forming the magnetic resin layer 11 includes a process of embedding a part of the magnetic resin layer 11 in the recessed part 50*x*. The process of forming the conductor layers 40*a* to 40*d* includes a process of forming the seed layers SL each including the spiral pattern and auxiliary pattern, a process of forming the resist pattern 51*a* selectively covering each seed layer SL, a process of applying electrolytic plating to each seed layer SL, and a process of selectively removing an unnecessary part of the conductor pattern by etching while leaving the spiral pattern. The process of removing an unnecessary conductor pattern includes a process of removing at least a part of the auxiliary pattern and simultaneously serves as a process of forming the recessed part 50*x*, so that it is possible to form the recessed part only by removing the unnecessary conductor pattern without conducting a special process.

The present invention has thus been shown and described with reference to specific embodiments. However, it should be noted that the present invention is not limited to the details of the described arrangements but changes and modifications may be made without departing from the scope of the appended claims.

For example, in the above embodiment, the outer auxiliary pattern 42*b* is formed only in the second and third conductor layers 40*b* and 40*c* (intermediate layers) and omitted in the first and fourth conductor layers 40*a* and 40*d*; however, the outer auxiliary pattern 42*b* may be formed in the first and fourth conductor layers 40*a* and 40*d*. That is, both the inner auxiliary pattern 42*a* and outer auxiliary pattern 42*b* may be connected to all the first to fourth spiral patterns C1 to C4. Further, although two inner auxiliary patterns 42*a* or two outer auxiliary patterns 42*b* are formed in one spiral pattern in the above embodiment, the number of the auxiliary patterns to be formed in one spiral pattern is not particularly limited and may be three or more, or one.

Further, although the coil part 20 has the four conductor layers 40*a* to 40*d* in the above embodiment, the number of the conductor layers is not particularly limited, but may be any number. Further, the number of turns of the coil pattern is also not particularly limited as long as the present invention remains effective.

Further, although the magnetic resin is used as a sealing member covering the coil part 20 in the above embodiment, non-magnetic resin not containing metal magnetic particles may be used to cover the coil part 20. Also in this case, adhesion between the sealing resin layer and the coil part 20 can be improved by the anchor effect.

Further, although the auxiliary pattern 42 is not completely removed but remains to some extent in the coil component 10 according to the present embodiment, it may be completely removed as long as coil characteristics are not affected.

What is claimed is:

1. A coil component comprising:

a coil part in which a plurality of conductor layers and a plurality of interlayer insulating layers are alternately laminated; and a sealing resin layer that covers the coil part, wherein the conductor layers each include a spiral pattern, the interlayer insulating layers each cover an upper surface and a side surface of the spiral pattern, a recessed part is formed in a side wall surface of the interlayer insulating layer, and a part of the sealing resin layer is embedded in the recessed part, at least one of the plurality of conductor layers further includes at least one auxiliary pattern connected to an innermost turn or an outermost turn of the spiral pattern, the interlayer insulating layer covers the upper and side surfaces of the spiral pattern and also covers an upper surface of the auxiliary pattern, and the recessed part is formed at a position from which a side surface of the auxiliary pattern is exposed.

2. The coil component as claimed in claim 1, wherein the sealing resin layer is a magnetic resin layer containing metal magnetic particles and resin binder, and the resin binder is embedded in the recessed part while preventing the metal magnetic particles from being embedded in the recessed part.

3. The coil component as claimed in claim 1, wherein the auxiliary pattern includes an inner auxiliary pattern connected to the innermost turn of the spiral pattern.

4. The coil component as claimed in claim 3, wherein the auxiliary pattern further includes an outer auxiliary pattern connected to the outermost turn of the spiral pattern.

5. The coil component as claimed in claim 4, wherein the coil part has three or more conductor layers, and both the inner auxiliary pattern and the outer auxiliary pattern are provided in an intermediate conductor layer between the lowermost and uppermost layers.

6. The coil component as claimed in claim 5, wherein the lowermost and uppermost conductor layers of the plurality of conductor layers have the inner auxiliary pattern and do not have the outer auxiliary pattern.

7. The coil component as claimed in claim 4, wherein the coil part is formed by alternately laminating first to fourth conductor layers and first to fourth interlayer insulting layers, the first and fourth conductor layers each include the spiral pattern and the inner auxiliary pattern, and the second and third conductor layers each include the spiral pattern, the inner auxiliary pattern and the outer auxiliary pattern.

8. The coil component as claimed in claim 1, wherein the auxiliary pattern has a bend.

9. The coil component as claimed in claim 1, wherein the plurality of conductor layers each have a seed layer and a plating layer formed on the seed layer by electrolytic plating, each spiral pattern is constituted by the seed layer and the plating layer, and the auxiliary pattern is constituted by the seed layer.

10. The coil component as claimed in claim 1, wherein the height of the recessed part is 1 μm to 10 μm.

11. The coil component as claimed in claim 1, wherein the depth of the recessed part is 3 mm to 25 mm.

12. A coil component comprising:

a first spiral conductive pattern including a plurality of turns having an innermost turn, each of the turns having a lower surface, an upper surface, an inner side surface, and an outer side surface;

a first insulating layer covering the lower surface of the first spiral conductive pattern; and a second insulating layer covering the upper surface, the inner side surface, and the outer side surface of the first spiral conductive pattern, a second spiral conductive pattern including a plurality of turns having innermost and outermost turns, each of the turns having a lower surface covered with the second insulating layer, an upper surface, an inner side surface, and an outer side surface; and a third insulating layer covering the upper surface, the inner side surface, and the outer side surface of the second spiral conductive pattern, wherein the second insulating layer includes a first inner wall covering the inner side surface of the innermost turn, wherein the first inner wall of the second insulating layer includes a first opening that exposes a part of the inner side surface of the innermost turn, wherein the third insulating layer includes a second inner wall covering the inner side surface of the innermost turn of the second spiral conductive pattern, wherein the second inner wall of the third insulating layer includes a third opening that exposes a part of the inner side surface of the innermost turn of the second spiral conductive pattern, wherein the third insulating layer further includes an outer wall covering the outer side surface of the outermost turn of the second spiral conductive pattern, and wherein the outer wall of the third insulating layer includes a fourth opening that exposes a part of the outer side surface of the outermost turn of the second spiral conductive pattern.

13. The coil component as claimed in claim 12, wherein the first inner wall of the second insulating layer further includes a second opening that exposes another part of the inner side surface of the innermost turn.

14. The coil component as claimed in claim 12, further comprising a magnetic resin layer embedded in an inner diameter area of the first spiral conductive pattern, wherein the magnetic resin layer comprises metal magnetic particles and resin binder, and wherein the resin binder is embedded in the first opening.

15. The coil component as claimed in claim 14, wherein the resin binder embedded in the first opening is in contact with the part of the inner side surface of the innermost turn.

16. The coil component as claimed in claim 14, wherein the metal magnetic particles are greater in size than the first opening.

17. The coil component as claimed in claim 12, wherein the part of the inner side surface of the innermost turn is located inside the first opening such that the part of the inner side surface of the innermost turn is arranged between the first insulating layer and the first inner wall of the second insulating layer.

18. A coil component comprising:

a first spiral conductive pattern including a plurality of turns having an innermost turn, each of the turns having a lower surface, an upper surface, an inner side surface, and an outer side surface;

a magnetic resin layer embedded in an inner diameter area of the first spiral conductive pattern;

a first insulating layer covering the lower surface of the first spiral conductive pattern; and a second insulating layer covering the upper surface, the inner side surface, and the outer side surface of the first spiral conductive pattern, wherein the second insulating layer includes a first inner wall covering the inner side surface of the innermost turn, wherein the first inner wall of the second insulating layer includes a first opening that exposes a part of the inner side surface of the innermost turn, wherein the magnetic resin layer comprises metal magnetic particles and resin binder, wherein the resin binder is embedded in the first opening, and wherein the metal magnetic particles are greater in size than the first opening.

* * * * *